US012188196B2

(12) United States Patent
Case

(10) Patent No.: US 12,188,196 B2
(45) Date of Patent: Jan. 7, 2025

(54) HIGH FLOW CAPACITY FLEXIBLE EARTH DRAINAGE SYSTEM AND METHOD FOR RELIEVING AND CONVEYING PORE WATER

(71) Applicant: American Prefabricated Drain, LLC, Waxhaw, NC (US)

(72) Inventor: John E. Case, Waxhaw, NC (US)

(73) Assignee: American Prefabricated Drain, LLC, Waxhaw, NC (US)

( * ) Notice: Subject to any disclaimer, the term of this patent is extended or adjusted under 35 U.S.C. 154(b) by 0 days.

(21) Appl. No.: 17/766,871

(22) PCT Filed: Oct. 7, 2020

(86) PCT No.: PCT/US2020/054547
§ 371 (c)(1),
(2) Date: Apr. 6, 2022

(87) PCT Pub. No.: WO2021/071924
PCT Pub. Date: Apr. 15, 2021

(65) Prior Publication Data

US 2024/0076846 A1 Mar. 7, 2024

Related U.S. Application Data

(60) Provisional application No. 62/911,562, filed on Oct. 7, 2019.

(51) Int. Cl.
*E02D 3/10* (2006.01)
*E02B 11/00* (2006.01)

(52) U.S. Cl.
CPC ..... *E02D 3/10* (2013.01); *E02B 11/00* (2013.01)

(58) Field of Classification Search
CPC . E02B 11/00; E02D 3/103; E02D 3/10; E02D 31/025
See application file for complete search history.

(56) References Cited

U.S. PATENT DOCUMENTS 4,582,611 A * 4/1986 Wang ..... B09C 1/02 210/170.07
4,622,138 A * 11/1986 Wager ..... E02D 3/10 210/170.07

(Continued)

FOREIGN PATENT DOCUMENTS

KR 100996027 B1 * 11/2010

*Primary Examiner* — Frederick L Lagman
(74) *Attorney, Agent, or Firm* — E. Eric Mills; Thomas R. Parker, II; Maynard Nexsen PC

(57) ABSTRACT

A high flow capacity flexible earth drainage system and method for relieving and conveying pore water is disclosed. In some embodiments, the presently disclosed high flow capacity flexible earth drainage system and method provide an arrangement of high flow capacity flexible earth drains, wherein each flexible earth drain may include one or more flexible ridged panels, one or more single-sided flexible ridged panels, one or more two-sided flexible ridged panels, and/or one or more flexible zigzag panels arranged longitudinal within a geotextile filter fabric sleeve. Further, a method is provided of installing the high flow capacity flexible earth drains to form the presently disclosed high flow capacity flexible earth drainage system for relieving and conveying pore water.

17 Claims, 21 Drawing Sheets

(56) References Cited

U.S. PATENT DOCUMENTS

| | | | | | |
|---|---|---|---|---|---|
| 4,639,165 | A * | 1/1987 | Flecknoe-Brown | E02D 3/10 | 428/116 |
| 4,733,989 | A * | 3/1988 | Harriett | C09J 123/02 | 405/50 |
| 4,815,892 | A | 3/1989 | Martin | | |
| 4,883,589 | A * | 11/1989 | Konon | B01D 17/0202 | 210/170.07 |
| 5,037,240 | A * | 8/1991 | Sherman | C02F 3/046 | 405/128.15 |
| 5,263,792 | A * | 11/1993 | Davis | E02B 11/00 | 428/137 |
| 6,312,190 | B1 * | 11/2001 | Goughnour | E02D 3/10 | 210/170.07 |
| 6,648,550 | B1 * | 11/2003 | Parker | E02B 11/00 | 52/169.5 |
| 2006/0021726 | A1 | 2/2006 | Wells | | |
| 2007/0218286 | A1 | 9/2007 | Bamforth | | |

* cited by examiner

HIGH FLOW CAPACITY FLEXIBLE EARTH DRAINAGE SYSTEM AND METHOD FOR RELIEVING AND CONVEYING PORE WATER

CROSS REFERENCE TO RELATED APPLICATIONS

This application is a 35 U.S.C. § 371 U.S. national phase entry of International Application No. PCT/US2020/054547 having an international filing date of Oct. 7, 2020, which claims benefit of U.S. Application No. 62/911,562 filed Oct. 7, 2019; each of which is incorporated herein by reference in its entirety.

TECHNICAL FIELD

The presently disclosed subject matter relates generally to methods of relieving static and seismically-induced pore water pressure in the ground and more particularly to a high flow capacity flexible earth drainage system and method for relieving and conveying pore water.

BACKGROUND

Natural subsurface deposits may comprise granular materials such as cobbles, gravel, sand, or non-plastic silt; cohesive materials, such as elastic silt or clay; organic deposits, such as organic silt or peat; or rock. The characterization of these materials is generally based on their grain size and plasticity. When subsurface soils exist below the ground water table, the voids, known as pores, between the particles are filled with water. The pore water provides buoyancy for the soil particles.

Surface loads, such as those associated with building foundations, earthen embankments, fuel storage tanks, and industrial facilities, exert pressure on subsurface materials when these facilities are constructed. The applied loads are initially resisted by the relatively incompressible pore water between the soil particles. The increase in the pore water pressure is called excess pore water pressure. With time, the pore water drains away from the area of the applied loads and the excess pore water pressure reduces. The time required for the pore water pressure to dissipate depends on the hydraulic conductivity of the soil, a parameter value that depends mostly on pore size and plasticity. Excess pore water pressures dissipate quickly in granular deposits, so much so that they are typically neglected in design for static loads. For cohesive soils, however, drainage can occur quite slowly, which often affects the performance of the completed structure. In these conditions, it is often helpful to provide drainage elements to speed the rate of drainage in silt and clay materials.

Vertical subsurface drainage elements have been used for nearly a century to assist in the drainage of cohesive materials. The earliest forms of these were sand drains consisting of vertical "columns" of sand placed within drilled or displaced holes. In the 1930's, Kjellman developed the first Prefabricated Vertical Drain (PVD) sometimes known as "wick drains." Kjellman's drain was comprised of cardboard strips surrounded by a porous filter fabric. The drain was pushed into the ground using a piling rig. Since the 1930's, many other forms of PVDs have been created and used for construction (see for example, U.S. Pat. Nos. 5,439,326; 5,658,091; 5,820,296; and 6,089,788. PVDs are pushed into the ground using a specialty designed piling rig equipped with a mast, a mandrel that houses the drain during pushing, a pushing motor, and a spindle that allows the drains to feed into the mandrel from a spool.

The PVDs are spaced close enough together to adequately facilitate drainage for the ensuing construction whereby the spacing depends on the construction sequence and tolerances, the hydraulic conductivity of the soil, and the dimensions of the drain. Larger diameter drains allow for wider spacing. Despite the advantage of larger drains, PVDs are typically on the order of ⅛-inch thick and three to four inches wide. The width is controlled by the width of the mandrel that is used to push the drain into the ground. The thickness is controlled by the ability of the drain to coil or "spool." The equivalent diameter is the diameter of a theoretical cylinder that has the same cross-sectional area as the rectangular drain. However, quick and efficient installation methods of installing larger equivalent diameter drains are currently limited.

Granular soils, such as gravel, sand, and non-plastic silt generally drain relatively quickly when static loads are applied slowly. However, when loads are applied rapidly, such as those associated with earthquakes, pore water pressures may also rise in these soils. During seismic events, strong ground motions are applied rapidly to the ground, often on the order of 20 to 30 strong cycles in a matter of seconds. Despite their higher hydraulic conductivities, granular soils have pore dimensions that are low enough to preclude rapid drainage and are thus subject to liquefaction. Accordingly, it may be beneficial to develop ways to economically drain the pore water pressure from granular soils during seismic events.

Liquefaction is a phenomenon that occurs when pore water pressure in the ground approaches the pressure induced by the soil overburden at a given depth. As the pore water pressure rises, the effect of buoyancy increases and the soil loses its strength. Liquefaction is the cause of many catastrophic failures, such as the near-overtopping of the Lower San Fernando dam in 1971 and the destruction of the majority of the buildings in the Central Business District in the city of Christchurch New Zealand in 2010-2011. In areas of known liquefaction hazards, pilings are often selected to support building foundations and other structures. Although pilings bypass the liquefiable soils and transmit surface loads to deeper non-liquefiable layers, they must nonetheless be designed to be stable as the more surficial liquefiable soils lose strength. Accordingly, it may be beneficial to provide an efficient and cost-effective method to retain the soil strength in the potentially liquefiable soils during seismic events.

A variety of ground improvement methods are also currently used to stabilize liquefiable soils. These methods reduce liquefaction potential by (a) increasing the density of the liquefiable soil, (b) increasing the lateral stress in the ground, (c) increasing the shear resistance of the ground, (d) binding the liquefiable particles together, and (e) increasing the rate of drainage of the ground. The Deep Dynamic Compaction (DDC) method, comprised of dropping a very heavy weight on the ground surface from a great height, has been used since the 1960's to increase the density of granular soils by heavy tamping. Rapid Impact Compaction (RIC) is a method developed by the British Military in the early 1990's that uses the same principles as DDC wherein the applied energy is facilitated by a pile driving hammer that strikes a heavy steel plate. Vibroflotation, comprised of lowering a hydraulic or electric vibrator in the ground, has been used since the 1930's to densify granular soils in place. Although the DDC, RIC, and vibroflotation methods may be economical, they each generate a large amount of shaking that may be damaging to adjacent structures. Further, the methods are limited in effectiveness to treating sites with "clean" sand, generally defined as sand deposits with less than about 15% of the materials passing through the No. 200 wash sieve that contains opening sizes of 75 micrometers. Accordingly, new approaches are needed with respect to liquefaction mitigation methods that may be used at sites with adjacent facilities and sites with variable fine soil content values.

Installation of traditional stone columns, which includes the use of a vibroflotation vibrator to compact inclusions of stone, is an outgrowth of vibroflotation and has been used for decades to increase the density of sands and gravels. The Rammed Aggregate Pier method, described in U.S. Pat. Nos. 5,249,892; 6,354,768; 7,604,437; and 9,512,568, includes using a specially designed compaction mandrel to vertically densify loose lifts of placed stone to a high density. The system applies lateral stress to the ground, densifies surrounding granular materials, and results in an increase in the composite axial and shear stiffness of the stabilized soil. The soil mixing method was introduced by the U.S. company Intrusion Prepakt in the 1950's and consists of binding soil particles together with either wet or dry cement. This method is effective at stabilizing ground that is not readily able to be densified. The stone column, Rammed Aggregate Pier, and soil mixing methods may be used to treat a wider range of soil materials, but are more expensive than DDC or RIC because they require large volumes of introduced materials. Accordingly, it may be beneficial to provide an economical method to mitigate soil liquefaction that may be used for soils with a variety of grain size distributions.

The "Earthquake Drain" method was introduced in the 1990's by Goughnour (see U.S. Pat. No. 5,800,090) to drain potentially liquefiable soils. The earthquake drain method is comprised of using an open-bottom hollow mandrel to push a perforated cylindrical plastic casing into the ground to the depth of desired liquefaction mitigation. A pervious geotextile filter fabric is affixed to the outside of the perforated casing before installation. The casing is placed on the inside of the mandrel and the bottom of the mandrel is sealed with a sacrificial steel plate. The mandrel is pushed into the ground and withdrawn, leaving the steel bottom plate and plastic drainage pipe in place. Earthquake drains are advantageous over conventional PVDs because they have a much larger interior storage volume that may be used to convey excess pore water that is generated by seismic events. This feature allows the drains to be used to treat liquefiable soils. However, the installation of earthquake drains is cumbersome and relatively slow because the method requires that each drainage element be inserted individually into the mandrel prior to driving. Accordingly, new approaches are needed with respect to providing the rapid and economic installation of high storage volume drains into the ground.

SUMMARY

The invention provides a method for the rapid installation of high flow capacity flexible vertical drainage elements into the ground to efficiently drain cohesive soil materials when loaded by static pressures and to efficiently mitigate the potential for soil liquefaction during seismic events. The invention provides for a spool-enabled high-flow capacity drain that may be coiled and spooled for efficient transport, rapid insertion on the installation rig, and continuous feeding through the installation mandrel. The features of the invention allow for the efficient and economical manufacturing of the drainage elements and allow for installation speeds as fast as those experienced using conventional PVDs. The invention provides great economy and efficiency for treating hard-to-mitigate granular soils that may be otherwise subject to devastating strength loss during seismic events.

In some embodiments, the presently disclosed high flow capacity flexible earth drainage subject matter provides an apparatus for providing high flow capacity flexible soil drains that may include a central core of synthetic material configured to provide for low bending stiffness; and a surrounding filter fabric.

In some embodiments, the presently disclosed high flow capacity flexible earth drainage apparatus may include a central core having two or more panels that may slip longitudinally along the length of the drain.

In some embodiments, the presently disclosed high flow capacity flexible earth drainage apparatus may include a central core having one or more panels that are scored with slits running transverse to the axis of the drain.

In some embodiments, the presently disclosed high flow capacity flexible earth drainage apparatus may include a central core is made of HDPE, HDPP, polyester, or the like.

In some embodiments, the presently disclosed high flow capacity flexible earth drainage apparatus may include a central core having two or more panels extruded using the same die.

In some embodiments, the presently disclosed subject matter provides a high flow capacity flexible earth drainage system and method for relieving and conveying pore water.

In some embodiments, the presently disclosed high flow capacity flexible earth drainage system and method provide an arrangement of high flow capacity flexible earth drains, wherein each flexible earth drain may include one or more flexible ridged panels arranged longitudinal within a geotextile filter fabric sleeve.

In some embodiments, the presently disclosed high flow capacity flexible earth drainage system and method provide an arrangement of high flow capacity flexible earth drains including one or more single-sided flexible ridged panels, meaning ridges extending from one side of a panel substrate.

In some embodiments, the presently disclosed high flow capacity flexible earth drainage system and method provide an arrangement of high flow capacity flexible earth drains including one or more two-sided flexible ridged panels, meaning ridges extending from both sides of a panel substrate.

In some embodiments, the presently disclosed high flow capacity flexible earth drainage system and method provide an arrangement of high flow capacity flexible earth drains, wherein each flexible earth drain may include one or more flexible zigzag panels arranged longitudinal within a geotextile filter fabric sleeve.

In some embodiments, the presently disclosed high flow capacity flexible earth drainage system and method provide an arrangement of high flow capacity flexible earth drains, wherein each flexible earth drain may include a specially designed plastic core comprised of one or more panels (e.g., flexible ridged panels) that can slip relative to each other lengthwise and sideways along the core, and a surrounding filtration material (e.g., geotextile filter fabric sleeve) that filters the natural soil from entering the drainage core during flow.

In some embodiments, the presently disclosed high flow capacity flexible earth drainage system and method provide an arrangement of high flow capacity flexible earth drains, wherein each flexible earth drain may include one or more flexible panels and wherein each flexible panel may include an arrangement of slots, notches, and/or V-grooves allowing a certain amount of bending or flexing of the high flow capacity flexible earth drains for coiling and spooling.

In some embodiments, the presently disclosed high flow capacity flexible earth drainage system and method provide a means for relieving static and seismically-induced pore water pressure in the ground and more particularly for the mitigation of liquefaction damage caused by earthquakes applied to granular in-situ ground materials.

In some embodiments, the presently disclosed high flow capacity flexible earth drainage system and method provide an economical drainage means to consolidate fine-grained cohesive materials subject to static vertical loads, wherein economy is gained by installing drains at wider spacing than afforded by conventional thin prefabricated vertical drains.

In some embodiments, the presently disclosed high flow capacity flexible earth drainage system and method provide an economical drainage means to rapidly and effectively drain excess pore water pressures from granular soil deposits that are subject to liquefaction upon seismic shaking.

In some embodiments, the presently disclosed high flow capacity flexible earth drainage system and method provide an economical method of installing an effective drainage system resulting from the arrangement of high flow capacity flexible earth drains.

In some embodiments, the presently disclosed high flow capacity flexible earth drainage system and method provide high flow capacity flexible earth drains formed of a relatively thick plastic material having the ability to serve as a drainage core while allowing for coiling and spooling.

In some embodiments, the presently disclosed high flow capacity flexible earth drainage system and method provide an economical method for manufacturing the drainage core elements of the high flow capacity flexible earth drains.

In some embodiments, the presently disclosed high flow capacity flexible earth drainage system for relieving and conveying pore water includes an arrangement of flexible earth drains, wherein each flexible earth drain includes one or more flexible panels within a filter sleeve.

In some embodiments, the arrangement of flexible earth drains is a line or an array with a spacing s between the flexible earth drains. The spacing s may vary. In one exemplary embodiment the spacing s may range from about 4.0 feet (about 1.22 meters) to about 10.0 feet (about 3.05 meters).

In some embodiments, the presently disclosed high flow capacity flexible earth drainage system may include one or more flexible panels arranged longitudinal within a filter sleeve, wherein the filter sleeve may be made of a geotextile fabric that is tubular shaped to fit around the one or more flexible panels. In one exemplary embodiment, the geotextile fabric may be SF-40 spunbond nonwoven geotextile filter fabric material.

In some embodiments, the presently disclosed high flow capacity flexible earth drainage system may include one or more flexible panels that is a pair of flexible ridged panels arranged back-to-back within the filter sleeve. In one exemplary embodiment, the overall height of the pair of flexible ridged panels may be about 0.75 inches (about 1.9 cm).

In some embodiments, the presently disclosed high flow capacity flexible earth drainage system may include one or more flexible panels that is a flexible ridged panel constructed by extrusion of a polymer through a die. In one exemplary embodiment, the polymer has a low friction angle, such as HDPE, HDPP, polyester polymers, composite synthetic materials, or the like.

In some embodiments, the presently disclosed high flow capacity flexible earth drainage system may include a flexible ridged panel that is a panel substrate with multiple ridges. In one exemplary embodiment, any two adjacent ridges of the multiple ridges coupled by a segment of the panel substrate form a rectangular element.

In some embodiments, the presently disclosed high flow capacity flexible earth drainage system may include a slot in each of the multiple ridges of a flexible ridged panel. In one exemplary embodiment, the slots are substantially in a line across the multiple ridges of the flexible ridged panel. In other exemplary embodiment, the slot is more than one slot along the length of each ridge of the flexible ridged panel. In another exemplary embodiment, the slot is a V-groove.

In some embodiments, the presently disclosed high flow capacity flexible earth drainage method may include the following steps: locating a first drain site; providing coils of high flow capacity flexible earth drains on spools; providing a driving rig with a driving mandrel; mounting the spools on the driving rig; feeding high flow capacity earth drains to and though driving mandrel of driving rig; attaching high flow capacity earth drains to sacrificial steel bar or plate; advancing driving mandrel holding high flow capacity earth drains into a ground; withdrawing driving mandrel from the ground and leaving the sacrificial steel bar or plate and high flow capacity flexible earth drains in the ground; cutting upper end of high flow capacity flexible earth drains and securing the high flow capacity flexible earth drains at the surface of the ground; moving the driving rig to a second drain site; and repeating the feeding step, the advancing step, the withdrawing step, and the cutting step.

BRIEF DESCRIPTION OF DRAWINGS

Figure 1:
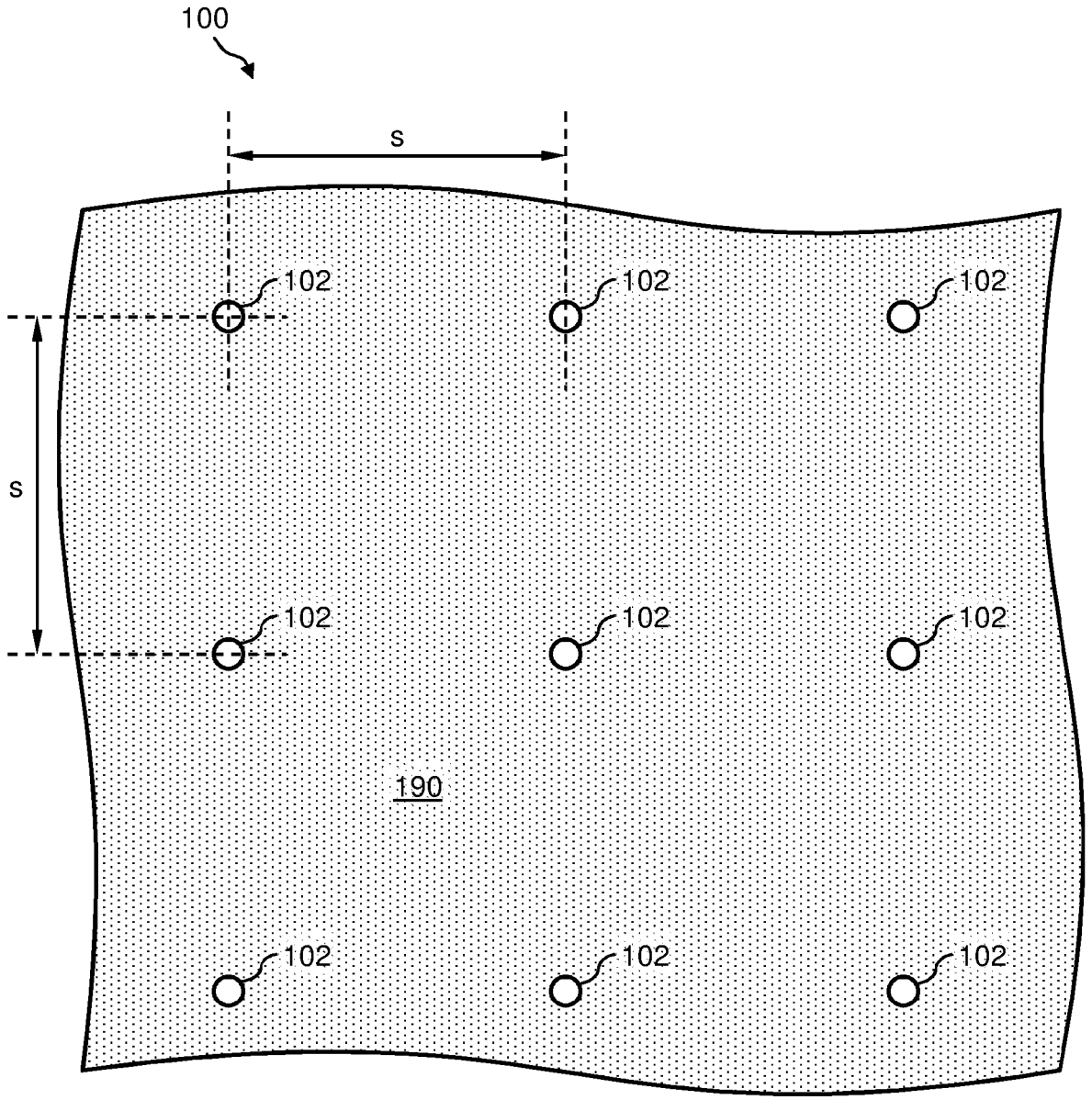
Figure 2:
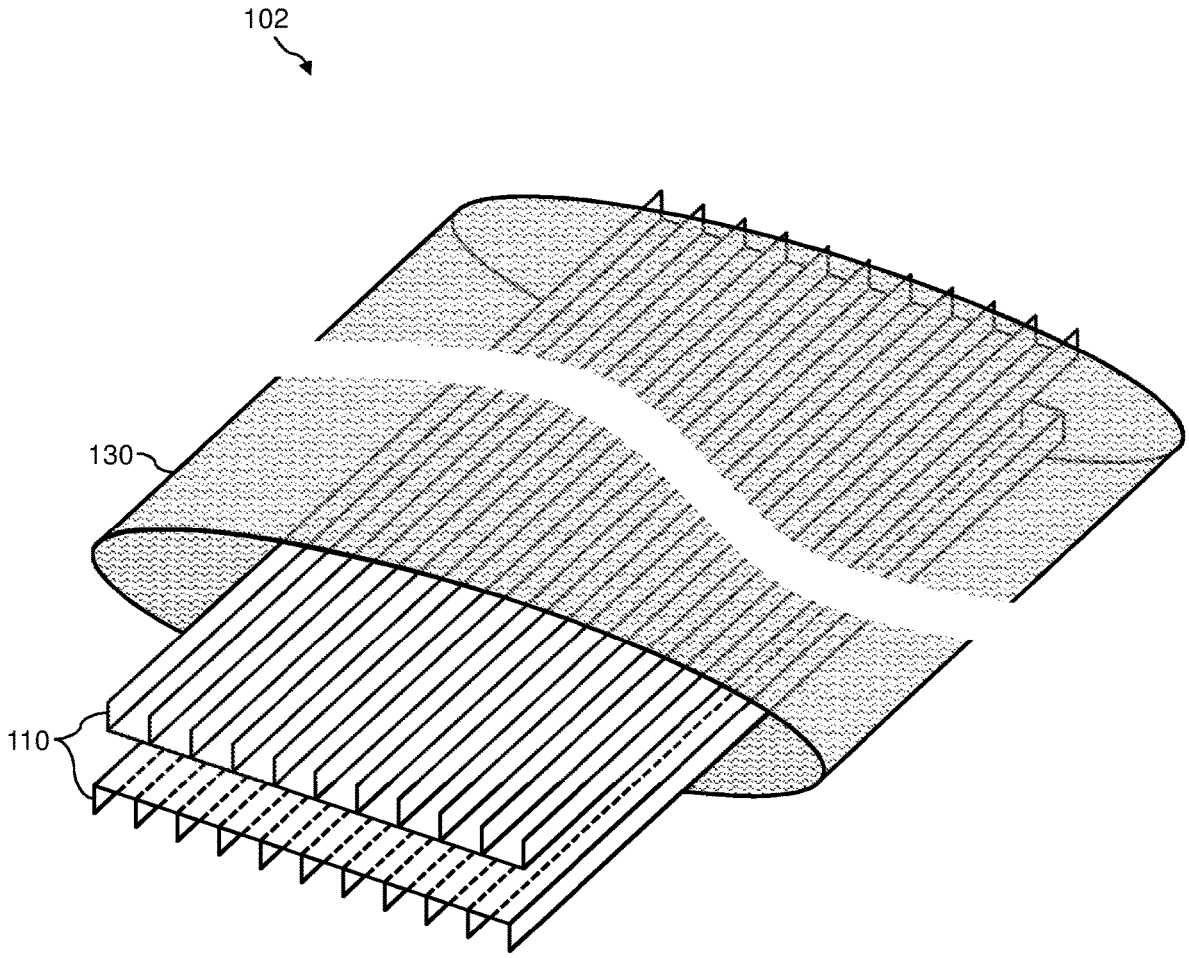
Figure 3:
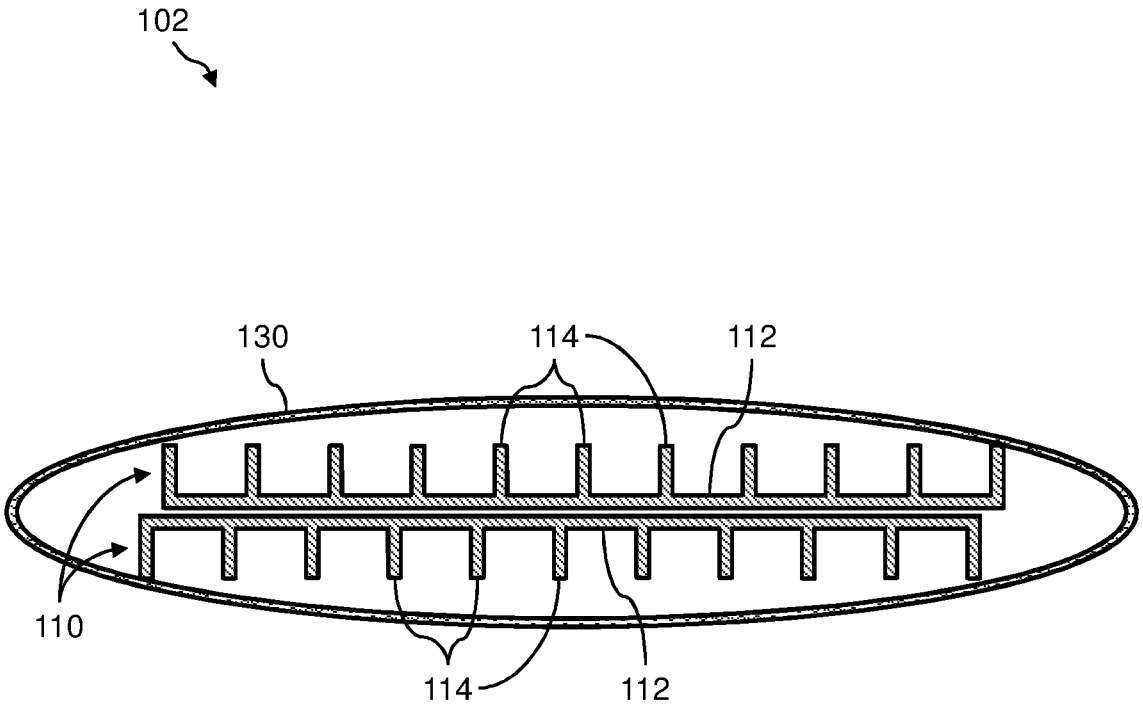
Figure 4:
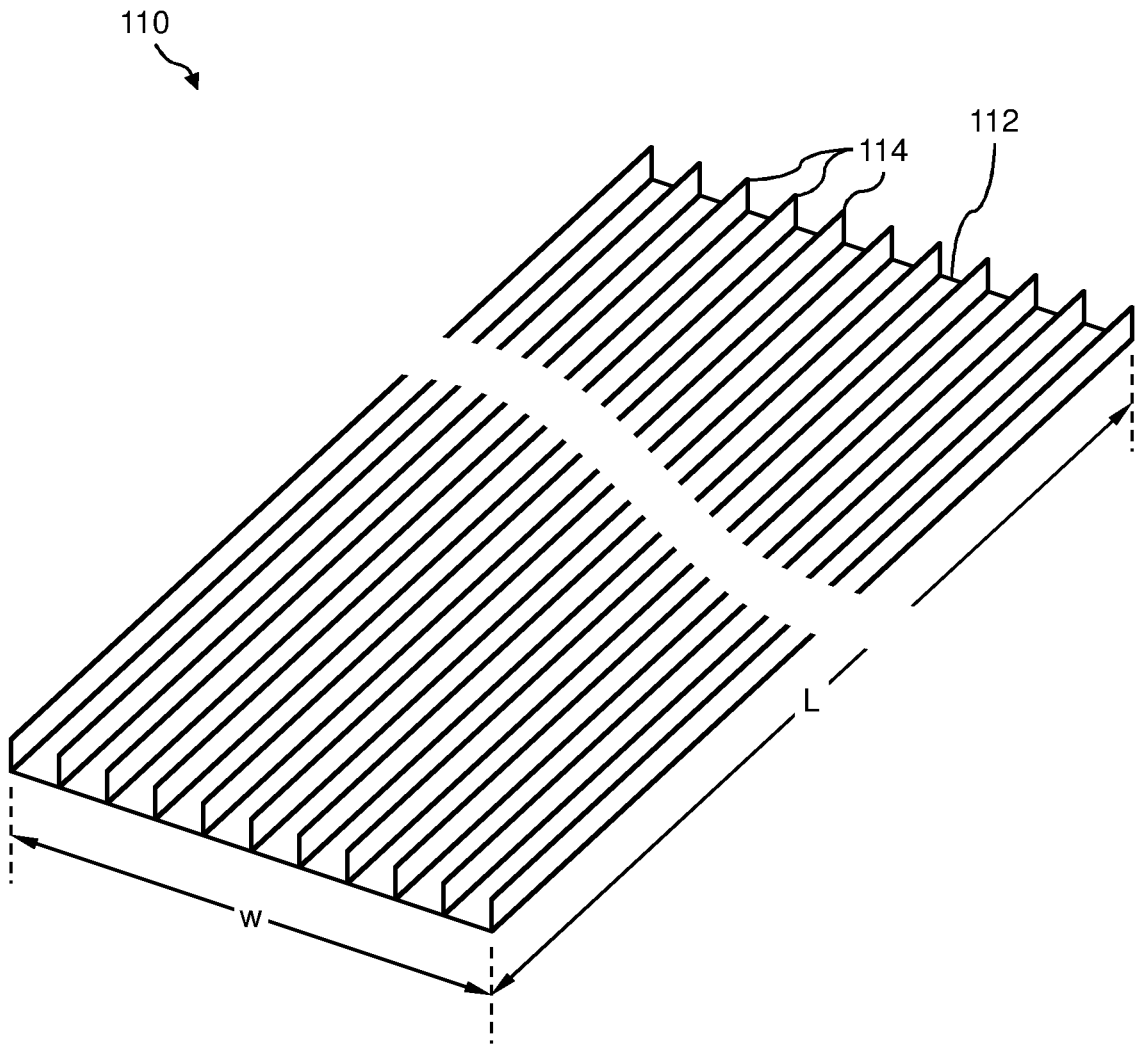
Figure 5:
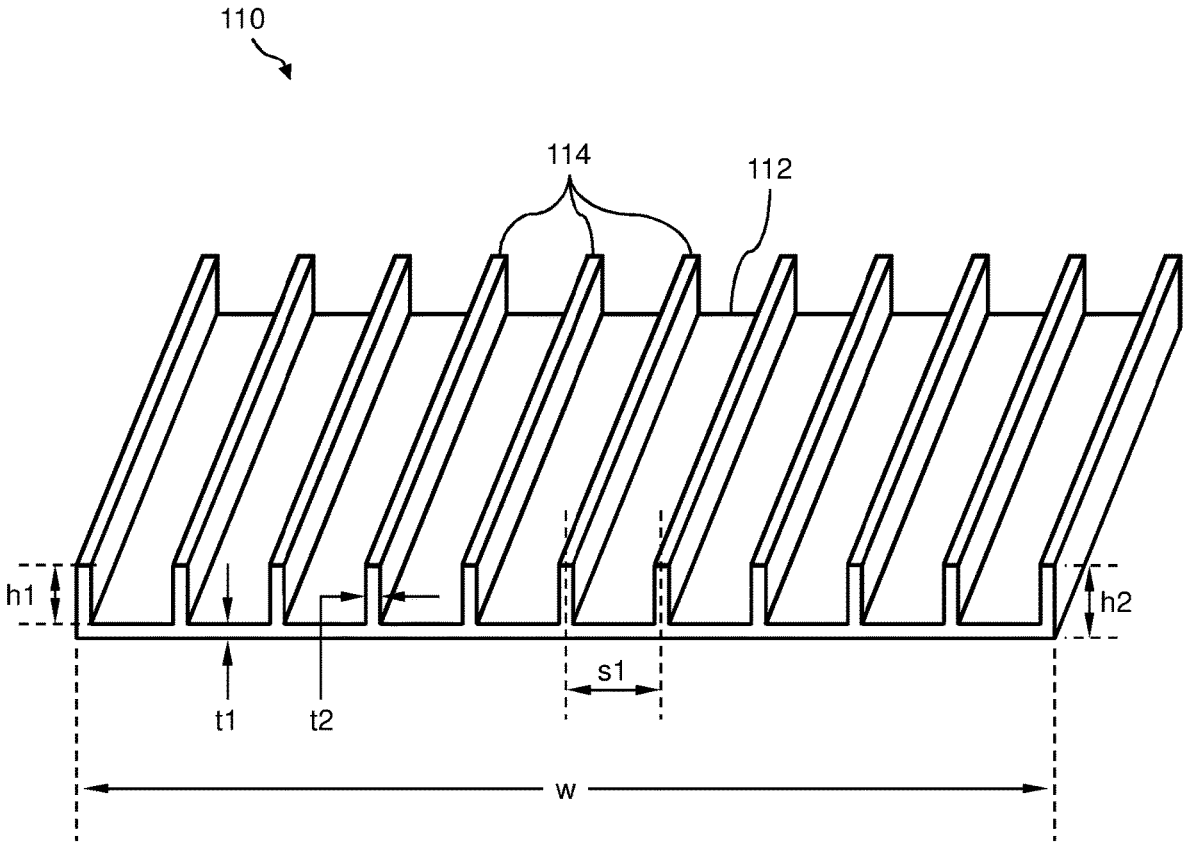
Figure 6:
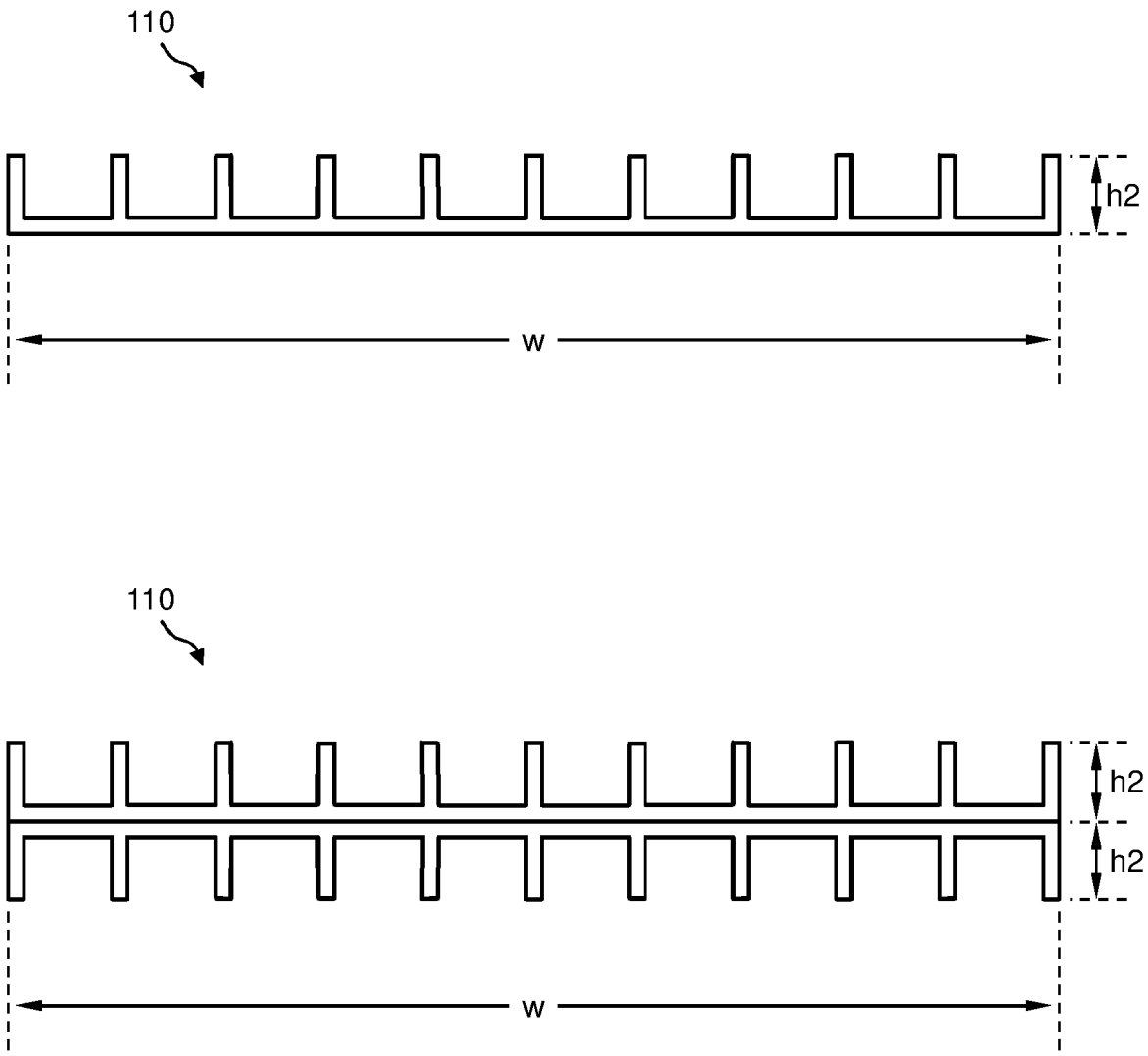
Figure 7:
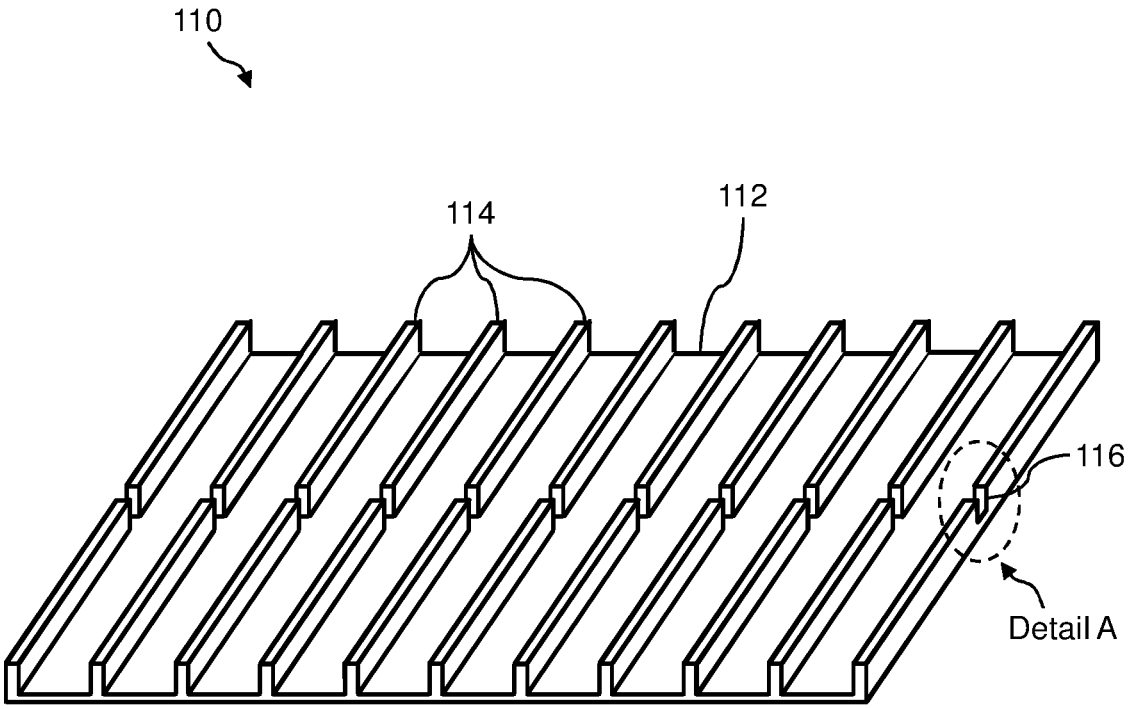
Figure 8:
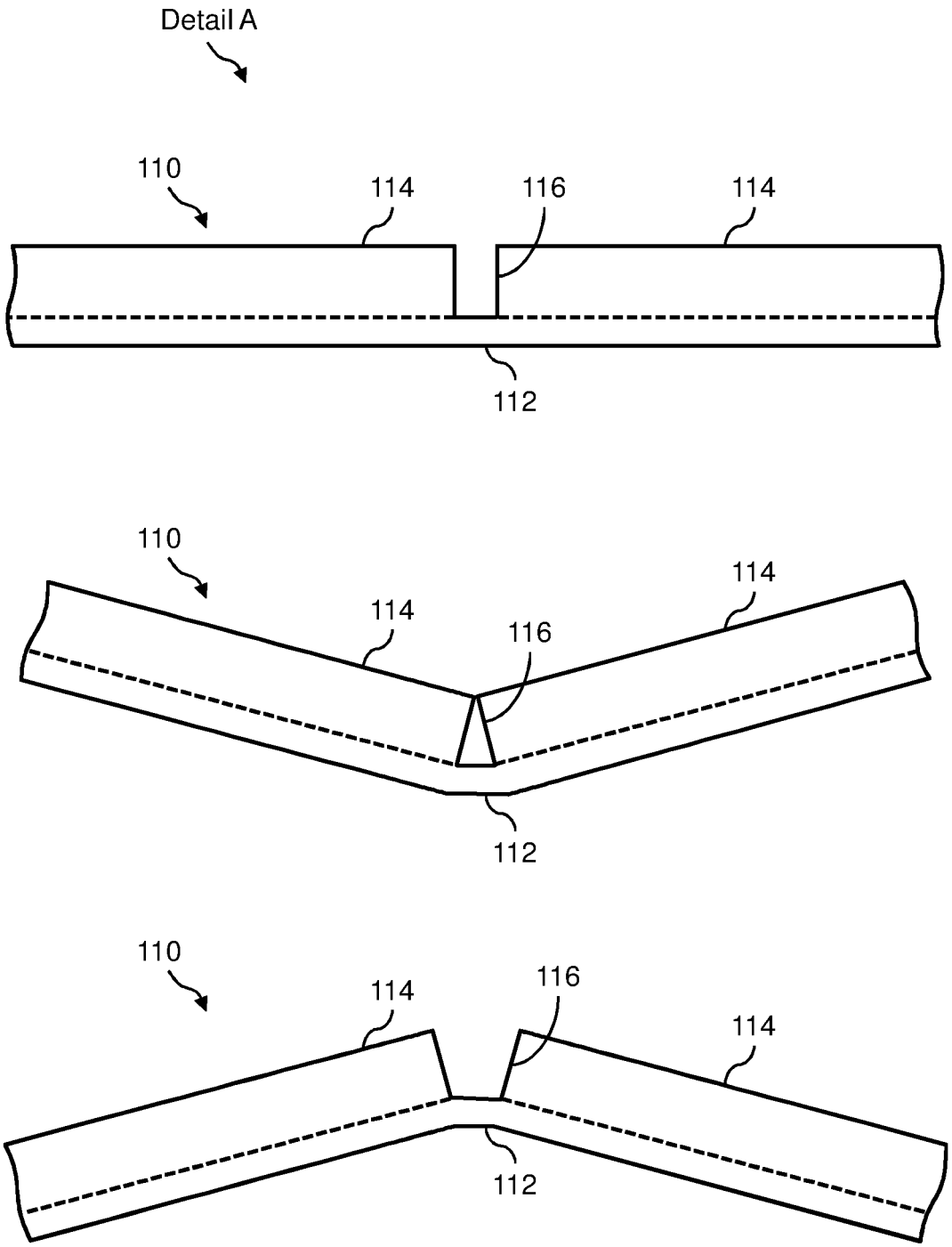
Figure 9:
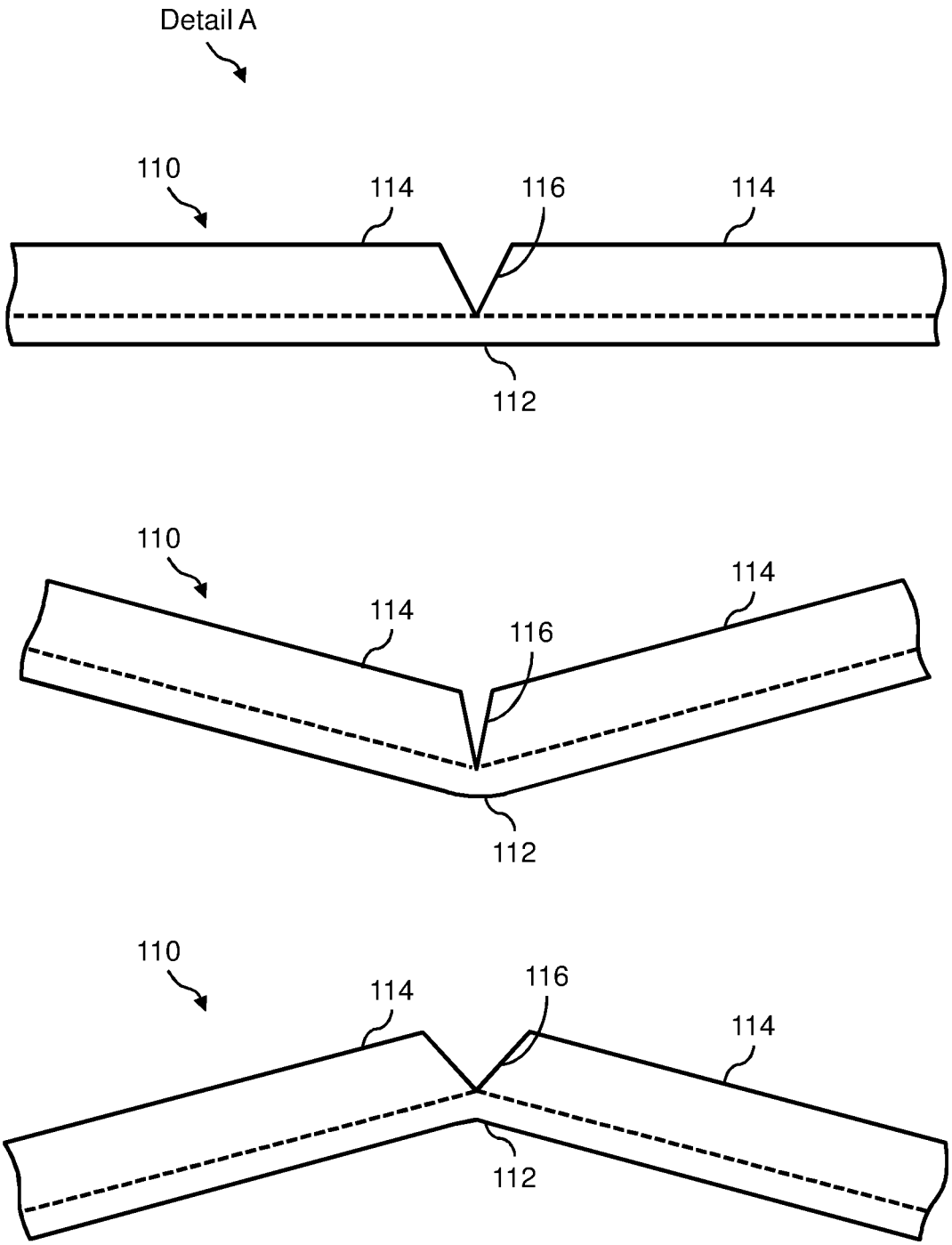
Figure 10:
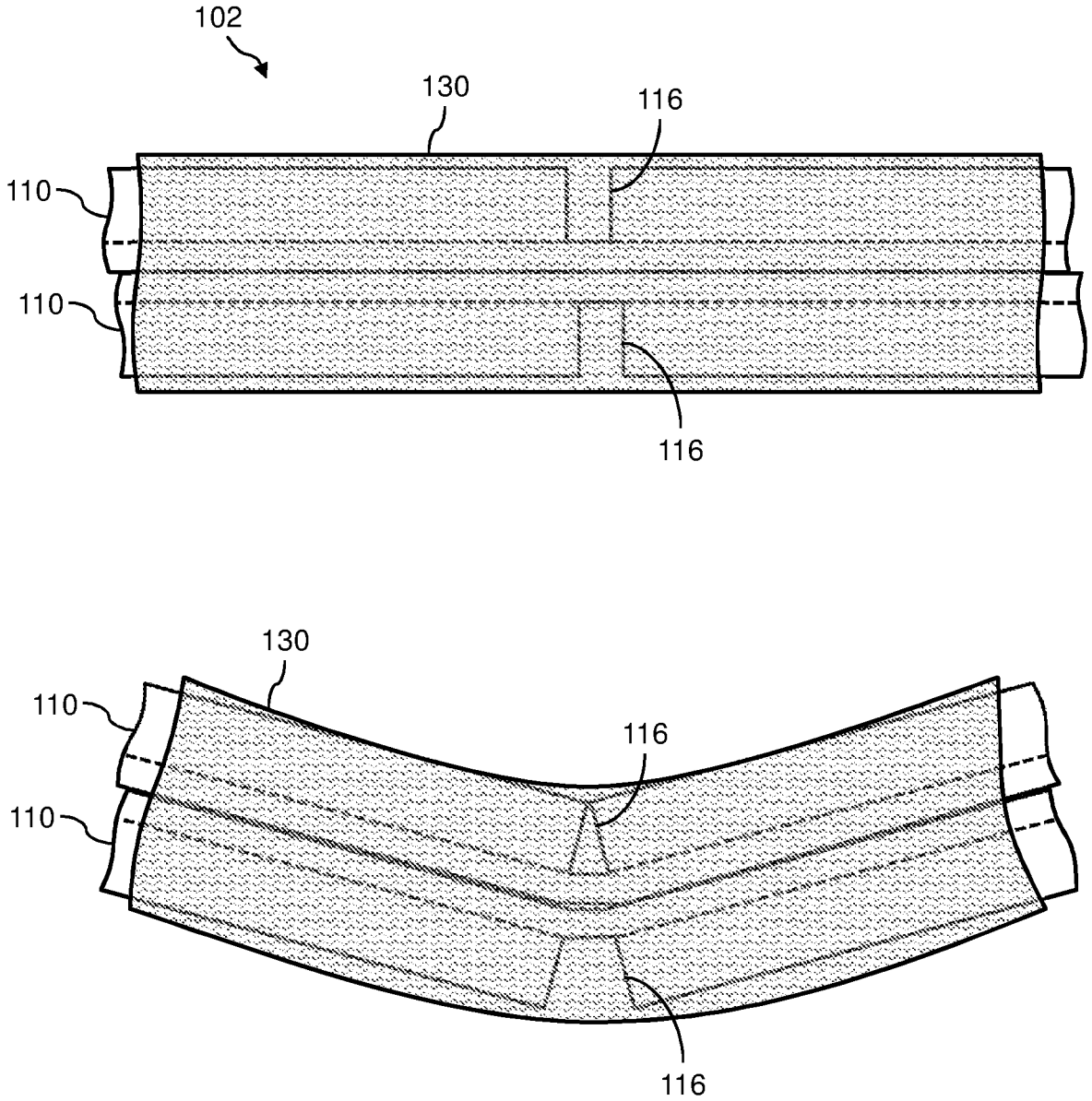
Figure 11A:
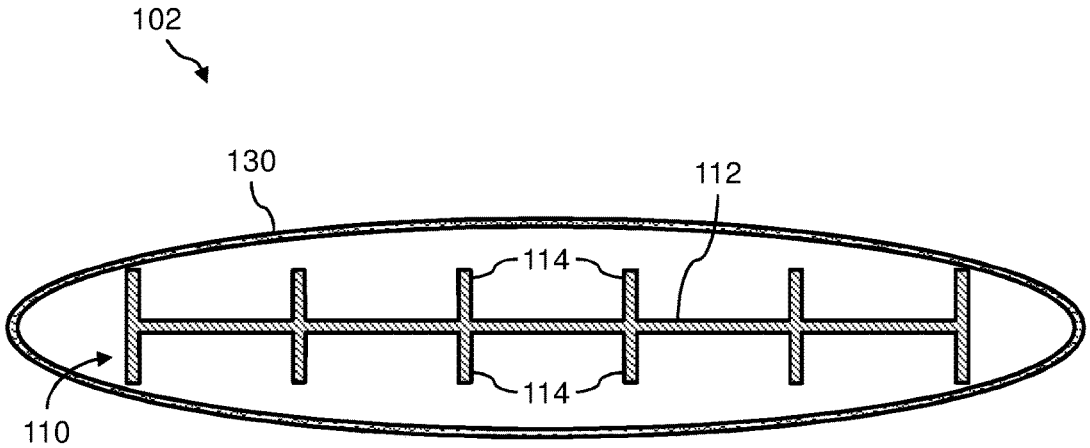
Figure 11B:
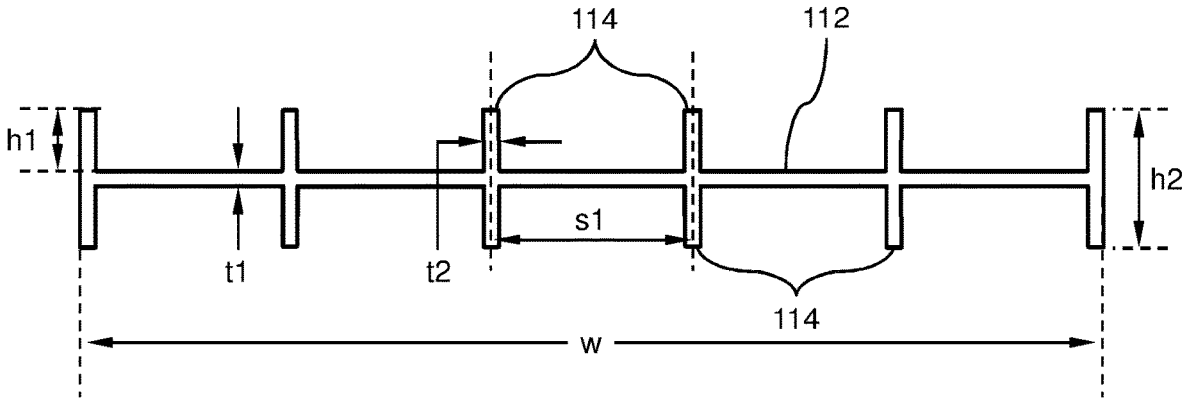
Figure 12:
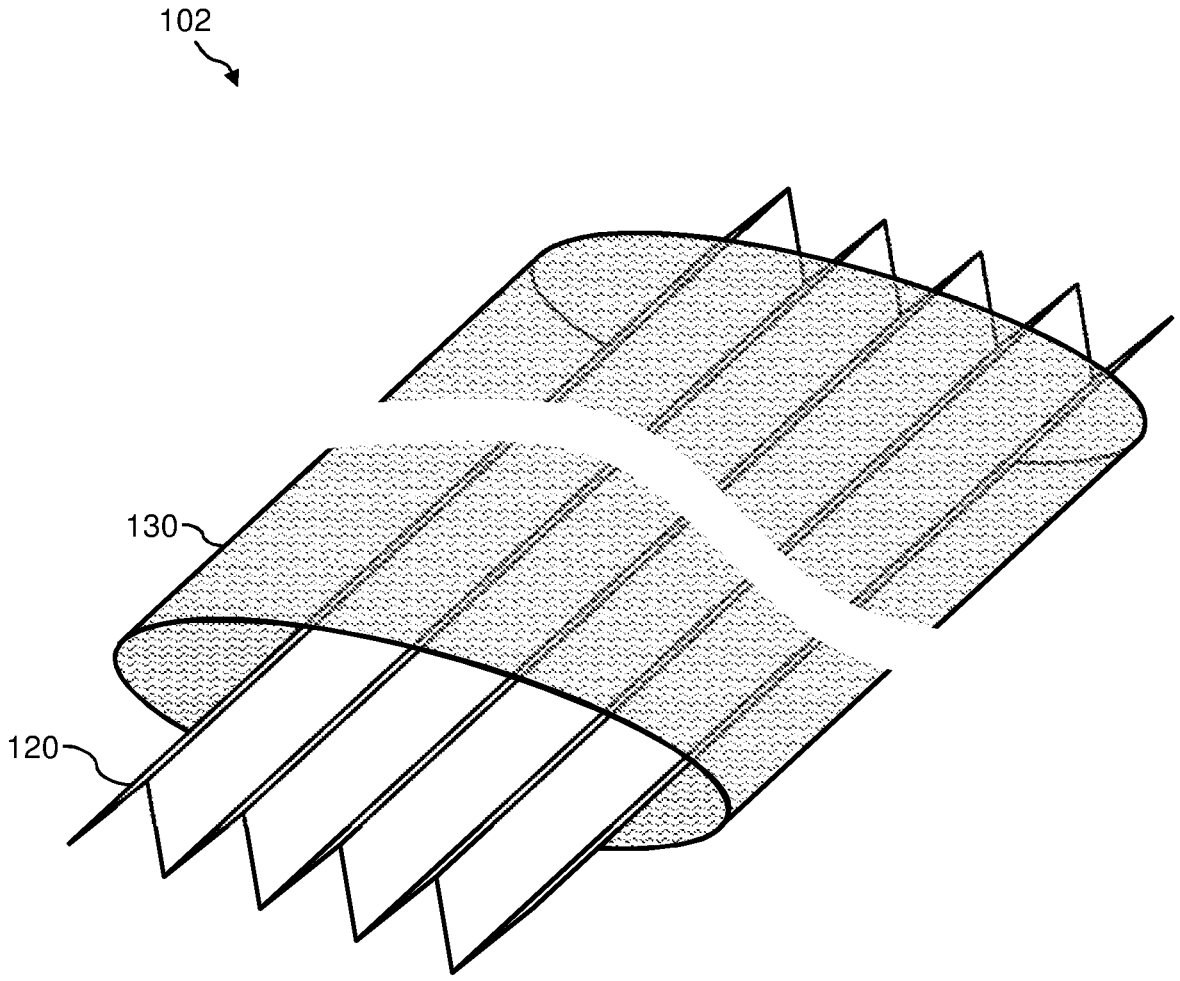
Figure 13:
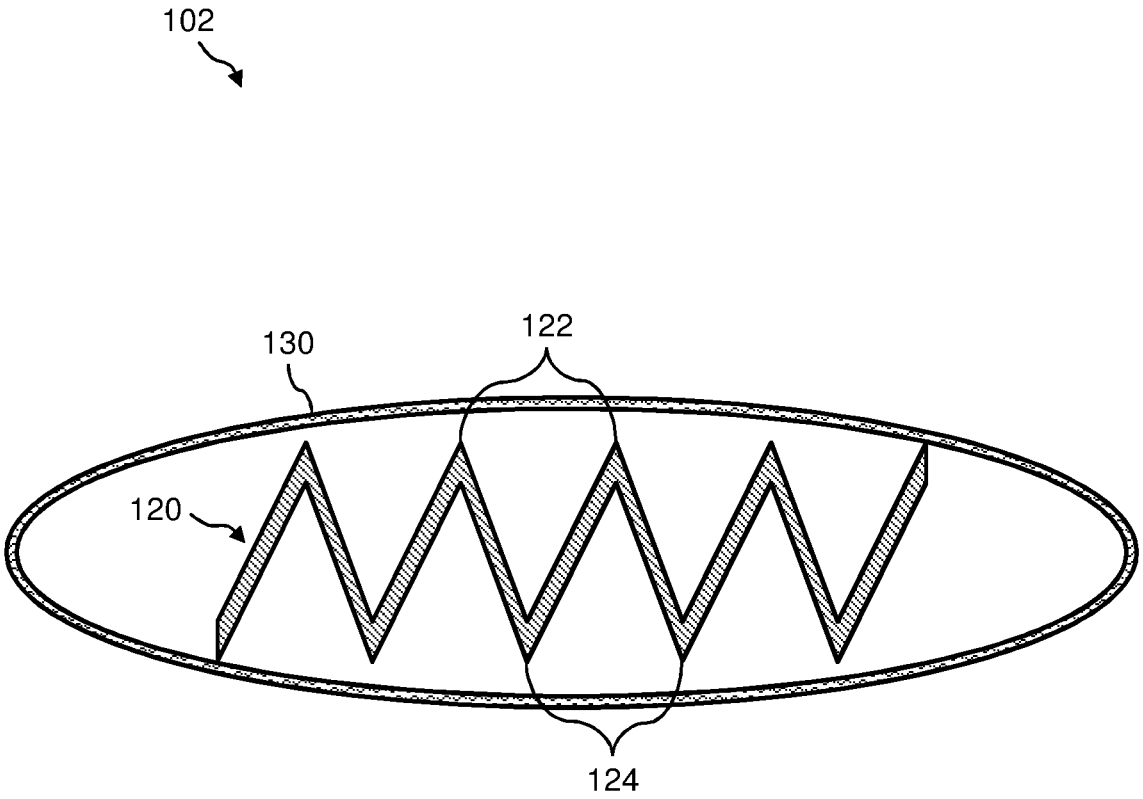
Figure 14:
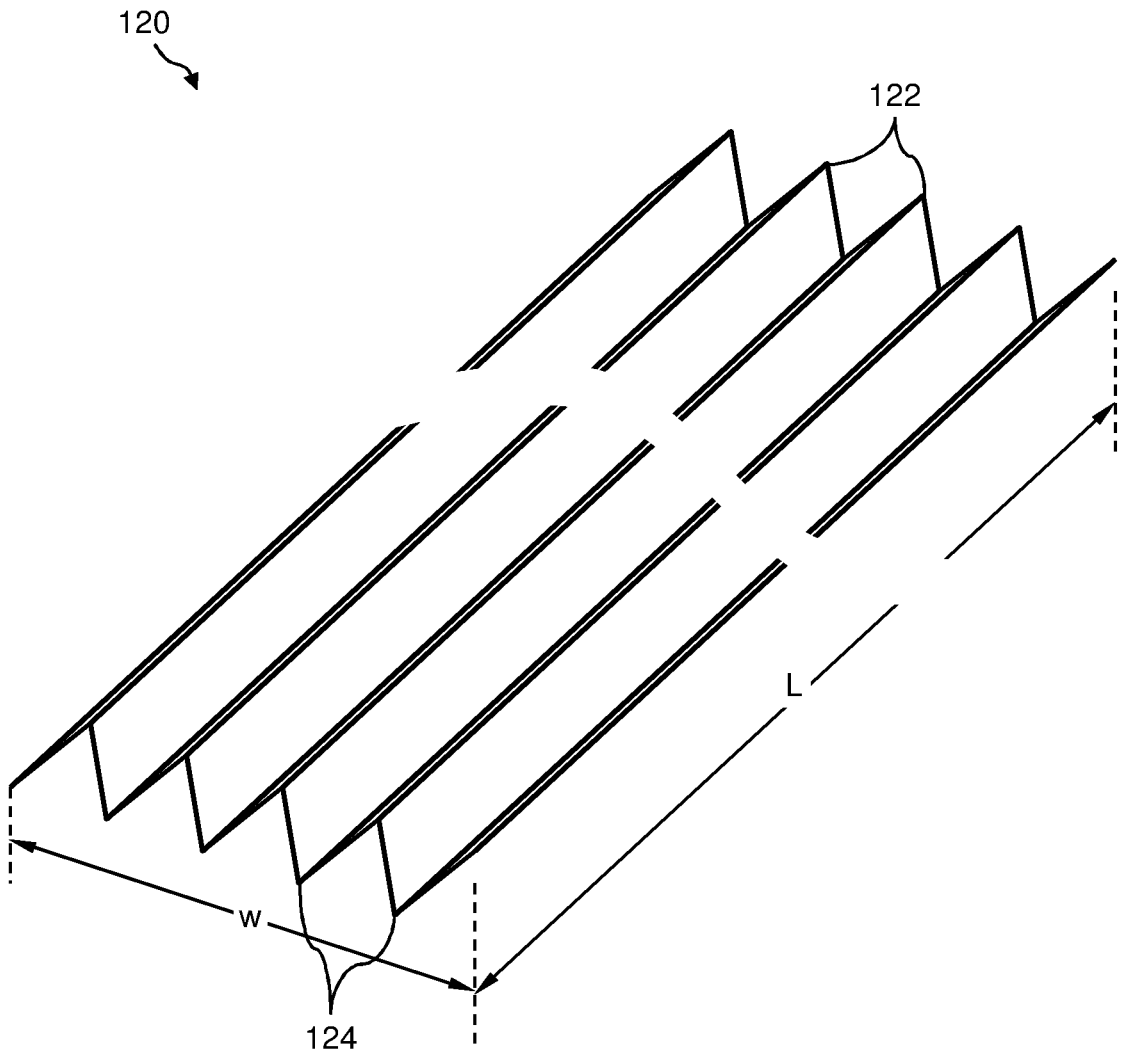
Figure 15:
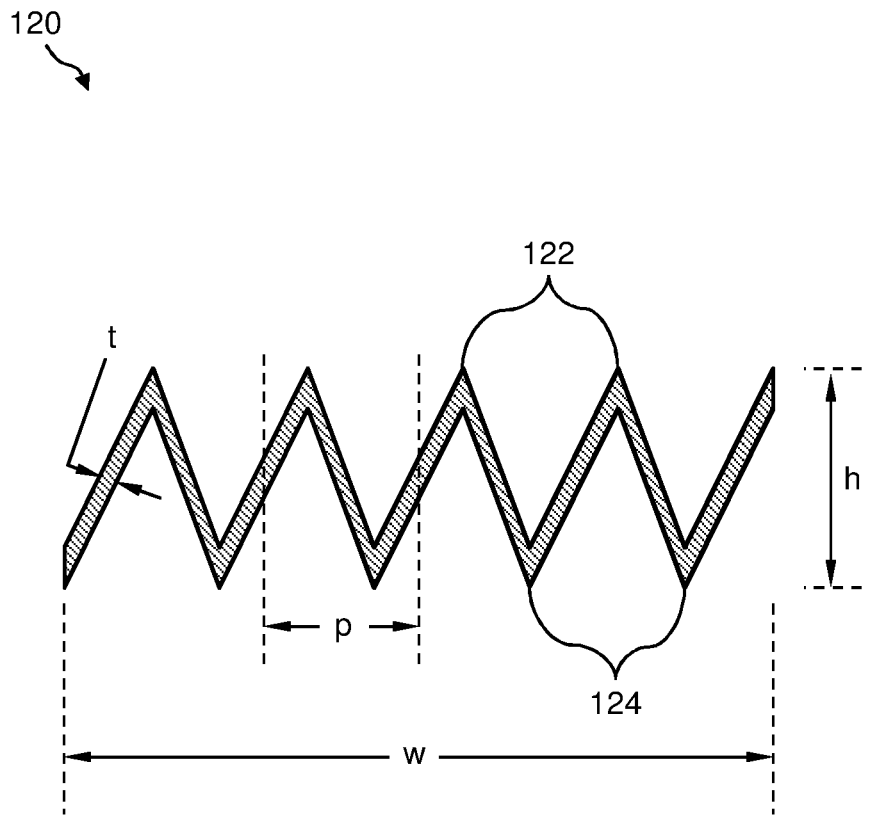
Figure 16:
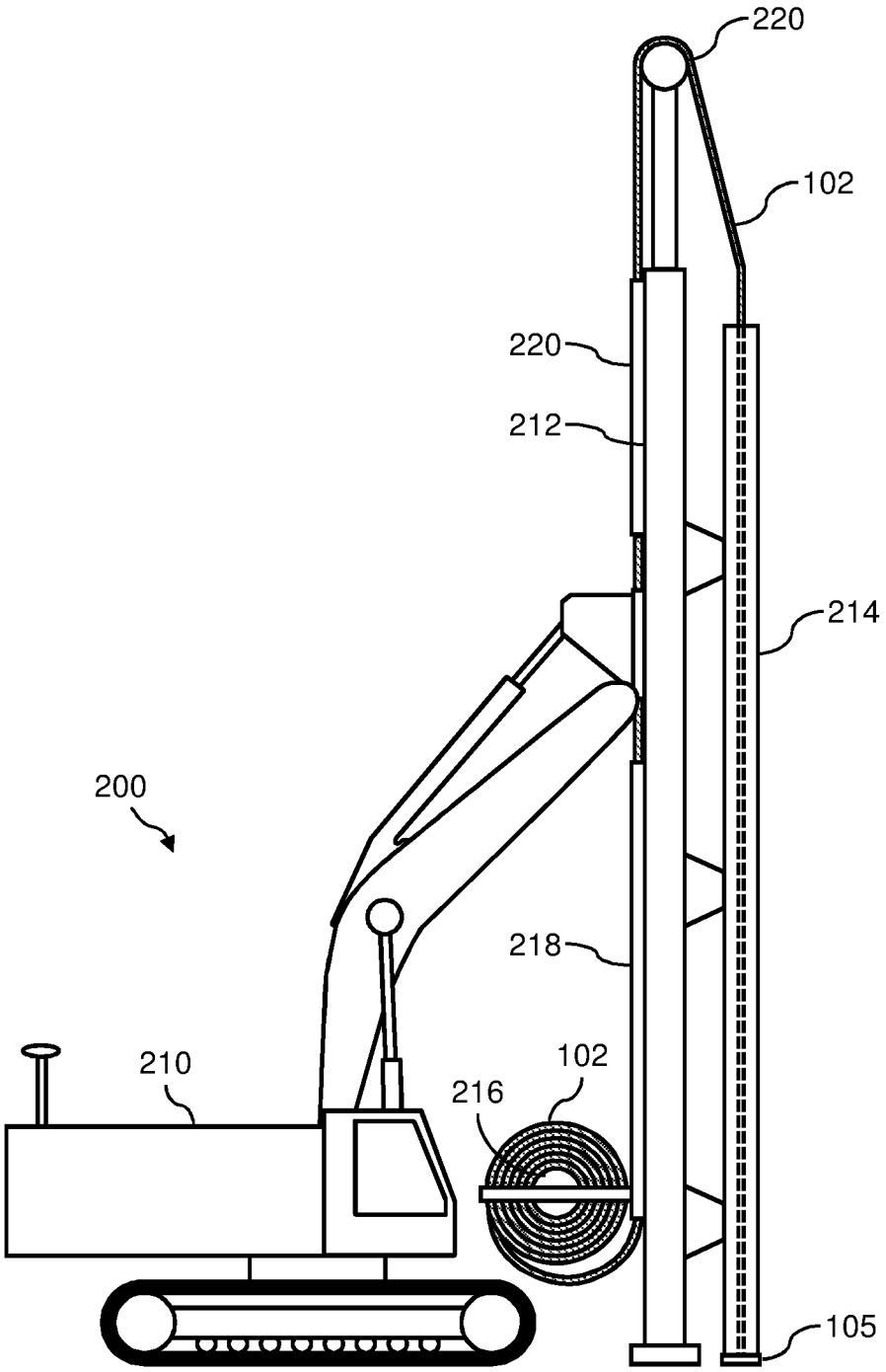
Figure 19:
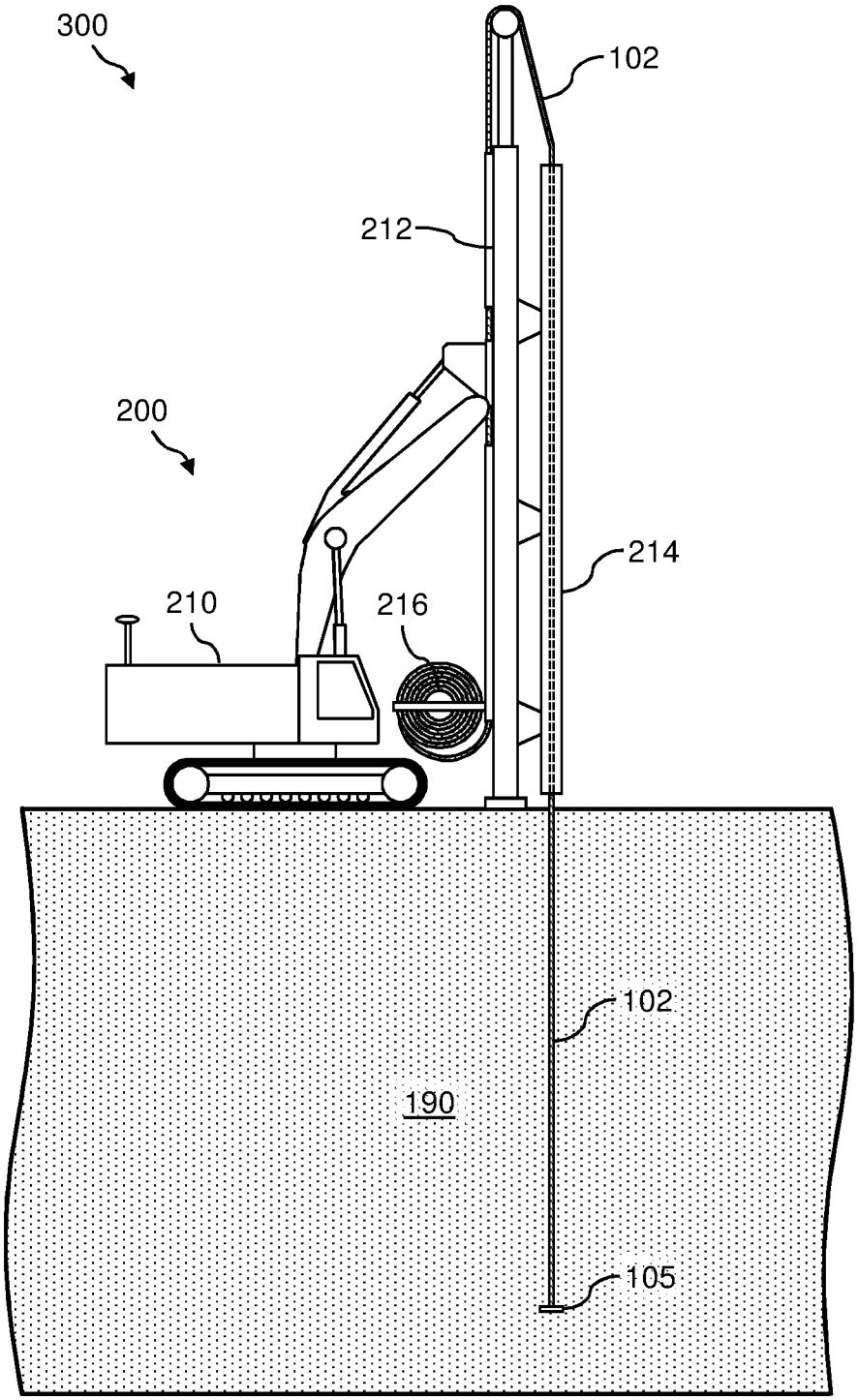
Figure 20:
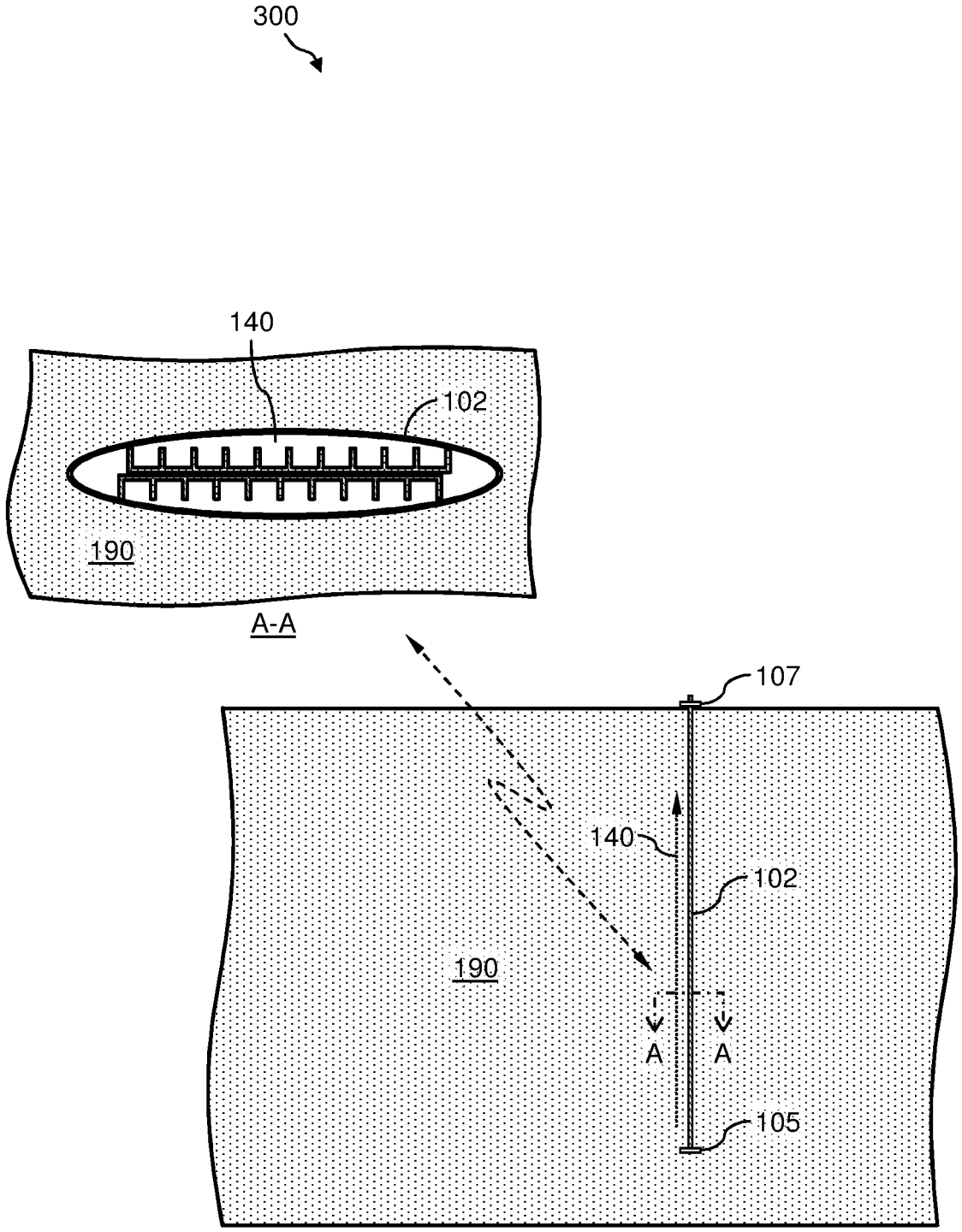
Figure 21:
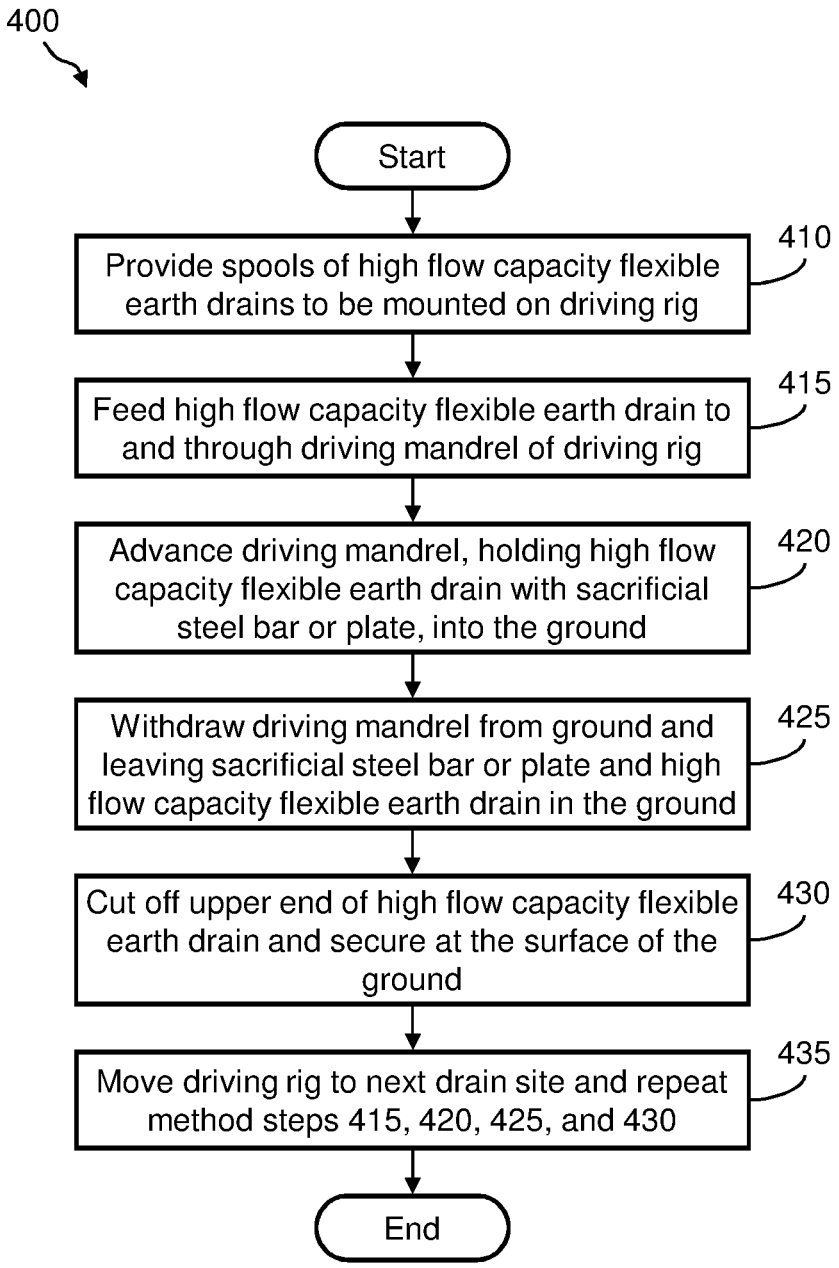

Having thus described the presently disclosed subject matter in general terms, reference will now be made to the accompanying drawings, which are not necessarily drawn to scale, and wherein:

FIG. 1 illustrates a plan view of an example of the presently disclosed high flow capacity flexible earth drainage system including an arrangement of high flow capacity flexible earth drains for relieving and conveying pore water;

FIG. 2 and FIG. 3 illustrate a perspective view and an end view, respectively, of an example of a flexible ridged earth drain for forming the presently disclosed high flow capacity flexible earth drainage system for relieving and conveying pore water;

FIG. 4 illustrates a perspective view of an example of a flexible ridged panel of the flexible ridged earth drain shown in FIG. 2 and FIG. 3;

FIG. 5, FIG. 6, and FIG. 7 illustrate various views showing more details of the flexible ridged panel shown in FIG. 4;

FIG. 8 illustrates side views showing slots for flexing the flexible ridged panel shown in FIG. 4 through FIG. 7;

FIG. 9 illustrates side views showing V-grooves or V-slots for flexing the flexible ridged panel shown in FIG. 4 through FIG. 7;

FIG. 10 illustrates side views showing an example of a process of flexing the flexible ridged earth drain of the presently disclosed high flow capacity flexible earth drainage system;

FIG. 11A and FIG. 11B illustrate end views of another example of the flexible ridged earth drain of the presently disclosed high flow capacity flexible earth drainage system;

FIG. 12 and FIG. 13 illustrate a perspective view and an end view, respectively, of an example of a flexible zigzag earth drain for forming the presently disclosed high flow capacity flexible earth drainage system for relieving and conveying pore water;

FIG. 14 and FIG. 15 illustrate a perspective view and an end view, respectively, of an example of a flexible zigzag panel of the flexible ridged earth drain shown in FIG. 12 and FIG. 13;

FIG. 16 illustrates a side view of an example of a driving rig for installing the flexible earth drains of the presently disclosed high flow capacity flexible earth drainage system;

FIG. 17, FIG. 18, FIG. 19, and FIG. 20 illustrate side views showing an example of a process of installing the flexible earth drains of the presently disclosed high flow capacity flexible earth drainage system; and FIG. 21 illustrates a flow diagram of an example of a method of installing flexible earth drains to form the presently disclosed high flow capacity flexible earth drainage system for relieving and conveying pore water.

DETAILED DESCRIPTION

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

In some embodiments, the presently disclosed high flow capacity flexible earth drainage subject matter provides an apparatus for providing high flow capacity flexible soil drains that may include a central core of synthetic material configured to provide for low bending stiffness; and a surrounding filter fabric.

In some embodiments, the presently disclosed high flow capacity flexible earth drainage apparatus may include a central core having two or more panels that may slip longitudinally along the length of the drain.

In some embodiments, the presently disclosed high flow capacity flexible earth drainage apparatus may include a central core having one or more panels that are scored with slits running transverse to the axis of the drain.

In some embodiments, the presently disclosed high flow capacity flexible earth drainage apparatus may include a central core is made of HDPE, HDPP, polyester, or the like.

In some embodiments, the presently disclosed high flow capacity flexible earth drainage apparatus may include a central core having two or more panels extruded using the same die.

In some embodiments, the presently disclosed subject matter provides a high flow capacity flexible earth drainage system and method for relieving and conveying pore water.

In some embodiments, the presently disclosed high flow capacity flexible earth drainage system and method provide an arrangement of high flow capacity flexible earth drains, wherein each flexible earth drain may include one or more flexible ridged panels arranged longitudinal within a geotextile filter fabric sleeve.

In some embodiments, the presently disclosed high flow capacity flexible earth drainage system and method provide an arrangement of high flow capacity flexible earth drains including one or more single-sided flexible ridged panels, meaning ridges extending from one side of a panel substrate.

In some embodiments, the presently disclosed high flow capacity flexible earth drainage system and method provide an arrangement of high flow capacity flexible earth drains including one or more two-sided flexible ridged panels, meaning ridges extending from both sides of a panel substrate.

In some embodiments, the presently disclosed high flow capacity flexible earth drainage system and method provide an arrangement of high flow capacity flexible earth drains, wherein each flexible earth drain may include one or more flexible zigzag panels arranged longitudinal within a geotextile filter fabric sleeve.

In some embodiments, the presently disclosed high flow capacity flexible earth drainage system and method provide an arrangement of high flow capacity flexible earth drains, wherein each flexible earth drain may include a specially designed plastic core comprised of one or more panels (e.g., flexible ridged panels) that can slip relative to each other lengthwise and sideways along the core, and a surrounding filtration material (e.g., geotextile filter fabric sleeve) that filters the natural soil from entering the drainage core during flow.

In some embodiments, the presently disclosed high flow capacity flexible earth drainage system and method provide an arrangement of high flow capacity flexible earth drains, wherein each flexible earth drain may include one or more flexible panels and wherein each flexible panel may include an arrangement of slots, notches, and/or V-grooves allowing a certain amount of bending or flexing of the high flow capacity flexible earth drains for coiling and spooling.

In some embodiments, the presently disclosed high flow capacity flexible earth drainage system and method provide a means for relieving static and seismically-induced pore water pressure in the ground and more particularly for the mitigation of liquefaction damage caused by earthquakes applied to granular in-situ ground materials.

In some embodiments, the presently disclosed high flow capacity flexible earth drainage system and method provide an economical drainage means to consolidate fine-grained cohesive materials subject to static vertical loads, wherein economy is gained by installing drains at wider spacing than afforded by conventional thin prefabricated vertical drains.

In some embodiments, the presently disclosed high flow capacity flexible earth drainage system and method provide an economical drainage means to rapidly and effectively drain excess pore water pressures from granular soil deposits that are subject to liquefaction upon seismic shaking.

In some embodiments, the presently disclosed high flow capacity flexible earth drainage system and method provide an economical method of installing an effective drainage system resulting from the arrangement of high flow capacity flexible earth drains.

In some embodiments, the presently disclosed high flow capacity flexible earth drainage system and method provide high flow capacity flexible earth drains formed of a relatively thick plastic material having the ability to serve as a drainage core while allowing for coiling and spooling.

In some embodiments, the presently disclosed high flow capacity flexible earth drainage system and method provide an economical method for manufacturing the drainage core elements of the high flow capacity flexible earth drains.

Features of the presently disclosed high flow capacity flexible earth drainage system and method may include, but are not limited to, (1) a flow capacity approximately one order of magnitude greater than that provided by conventional thin prefabricated vertical drains; (2) a specially configured core that allows for coiling and spooling and thereby further allows for rapid installation operations; and (3) an economical and effective drainage system for new earthen embankments, fuel storage tanks, large foundations, and sites subject to liquefaction that would otherwise be deemed to be unstable.

Referring now to FIG. 1 is a plan view of an example of the presently disclosed high flow capacity flexible earth drainage system 100 including an arrangement of high flow capacity flexible earth drains 102 for relieving and conveying pore water. Each of the flexible earth drains 102 may include, for example, one or more three-dimensional flexible panels arranged longitudinal within a geotextile filter fabric sleeve. More details of examples of flexible earth drains 102 including flexible "ridged" panels are shown and described hereinbelow with reference to FIG. 2 through FIG. 11B. More details of examples of flexible earth drain 102 including flexible "zigzag" panels are shown and described hereinbelow with reference to FIG. 12 through FIG. 15.

In high flow capacity flexible earth drainage system 100, one or more high flow capacity flexible earth drains 102 may be provided in any configuration, such as a line or array. The high flow capacity flexible earth drains 102 may be installed with a spacing s. The spacing s may range, for example, from about 4.0 feet (about 1.22 meters) to about 10.0 feet (about 3.05 meters). In one example, the spacing s may be about 5 feet (about 1.52 meters).

Because of the high flow capacity of the flexible earth drains 102 of high flow capacity flexible earth drainage system 100 as compared with using conventional vertical drains, the spacing s can be maximized, which results in fewer drain sites and lower cost as compared with conventional drainage systems.

Referring now to FIG. 2 and FIG. 3 is a perspective view and an end view, respectively, of an example of a flexible "ridged" earth drain 102 for forming the presently disclosed high flow capacity flexible earth drainage system 100 shown in FIG. 1. Namely, flexible ridged earth drain 102 is an example of the high flow capacity flexible earth drain 102 shown in FIG. 1. In this example, flexible ridged earth drain 102 may include a pair of flexible ridged panels 110 arranged back-to-back within a geotextile filter fabric sleeve 130. Geotextile filter fabric sleeve 130 may be, for example, a long strip of geotextile filter fabric material that is folded over and sewn lengthwise to provide a tubular shape that fits around flexible ridged panels 110. The geotextile filter fabric material may be, for example, the SF-40 spunbond nonwoven geotextile filter fabric material available from DuPont de Nemours, Inc.

As shown in FIG. 3, each of the flexible ridged panels 110 may include a panel substrate 112 having an arrangement of ridges 114 protruding substantially orthogonally from one side of the panel substrate 112.

In one example, flexible ridged panels 110 may be constructed by conventional extrusion of the melted polymer through a die. The die is configured to enable the extrusion of the channelized cross-sectional shape that is comprised of panel substrate 112 and multiple ridges 114. FIG. 4 shows that each flexible ridged panel 110 has a width w. The width w may be selected so that flexible ridged panel 110 is wide enough to result in high flow capacity yet fit within a conventional pushing mandrel, as shown in FIG. 16. The width w may typically range, for example, from about 3.0 inches (about 7.62 cm) to about 4.0 inches (about 10.16 cm). Further, FIG. 4 shows that each flexible ridged panel 110 has a length L, wherein the length L may be several feet or meters. Accordingly, each flexible ridged earth drain 102 may be several feet or meters long.

In one example and referring now to FIG. 5, flexible ridged panel 110 has eleven (11) ridges 114 protruding substantially orthogonally from one side of the panel substrate 112. In this example, the eleven ridges 114 can have an on-center spacing s1 typically, for example, in the range of about 0.25 inches (about 0.64 cm) to about 0.5 inches (about 1.27 cm). The on-center spacing s1 of ridges 114 may be selected to be large enough to result in high flow capacity yet provides sufficient support for geotextile filter fabric sleeve 130 when installed below grade. Accordingly, in this example, flexible ridged panel 110 has a width w of about 4 inches (about 10.16 cm). Further, panel substrate 112 of flexible ridged panel 110 has a thickness t1 and each ridge 114 has a thickness t2. The thicknesses t1 and t2 may range, for example, from about 0.15 inches (about 0.38 cm) to about 0.25 inches (about 0.64 cm).

Further, each ridge 114 has a height h1 and total height h2 (h2 being the sum of h1 and t1). The height h2 of ridges 114 may be selected so that they are long enough to result in high flow capacity yet still provide for a panel that is sufficiently flexible for efficient coiling and spooling, such as shown in FIG. 16. The height h2 may range, for example, from about 0.375 inches (about 0.95 cm) to about 0.75 inches (about 1.91 cm). Further, alternative materials and dimensions may be used provided that they allow effective flow volumes and drain stability.

Referring now to FIG. 6, if one flexible ridged panel 110 has an overall height h2, then two flexible ridged panels 110 arranged back-to-back have an overall height of h2×2. In one example, the overall height, which is h2×2, may be about 0.75 inches (1.9 cm). Referring now again to FIG. 2 through FIG. 6, flexible ridged panels 110 may be formed of durable materials that have low friction angle, such as, but not limited to, high-density polyethylene (HDPE) polymers, high-density polypropylene (HDPP) polymers, polyester polymers, composite synthetic materials, and the like. In each case, the low friction angle of, for example, two flexible ridged panels 110 arranged back-to-back (see FIG. 3) allows the panels to slip relative to each other. The ability of the flexible ridged panels 110 to slip relative to each other allows lengths of flexible ridged earth drain 102 to be coiled and mounted on a spool, as shown in FIG. 16.

In flexible ridged panels 110, any two adjacent ridges 114 coupled by a segment of panel substrate 112 form a rectangular element. As is well known in mechanics, the stiffness of a rectangular element to rotation (bending) about its neutral axis is computed as:

I=1/12bh3, where b is the width of the rectangle (the on-center spacing s1) and h is the height of the rectangle (the overall height h2). The bending stiffness (I) of a traditional PVD drain with a rectangle width of 1/32 inches and a rectangle height of 1/8-inch and ten ridges each with a thickness of 1/32 inches is thus 0.00005 in4. Referring to the present invention, the bending stiffness of a single rectangle element with a rectangle width of 1/32 inches and a rectangle height of 0.375 inches is 0.00014 in4; the bending stiffness therefore of 10 ridges 114 in parallel is 10 times as stiff or 0.0014 in4. The bending stiffness of two back-to-back channels that comprise this invention is thus 0.0027 in4. In contrast, the bending stiffness of a unitary (no panel) channel formed using the non-slip geometry of the prior art and comprised of, for example, 10 flanges, without the potential for panel slipping with a flange width of 1/32 inches and a height of 3/4 inches is 0.011 in4. In this way, flexible ridged panels 110 of high flow capacity flexible earth drain 102 reduce the bending stiffness of a high flow capacity drainage element from 0.0011 in4 to 0.0027 in4, a four-fold reduction in stiffness. This reduction in bending stiffness allows for coiling and spooling as shown in FIG. 16.

Additionally, flexible ridged panels 110 may include other features for assisting flexible ridged earth drain 102 to be coiled and mounted on a spool, as shown below in FIG. 7 through FIG. 10. For example, FIG. 7 shows a portion of a flexible ridged panel 110 and wherein a slot (or notch) 116 is provided in each ridge 114. The slots 116 are provided substantially in a line across flexible ridged panel 110. Each slot 116 is formed substantially within its ridge 114 and not extending into panel substrate 112.

Referring now to FIG. 8 is side views showing a slot 116 for flexing the flexible ridged panel 110 shown in FIG. 4 through FIG. 7. Namely, FIG. 8 shows a Detail A of FIG. 7 that shows an example of a slot 116 that may be used to assist coiling and spooling flexible ridged earth drain 102. First, FIG. 8 shows flexible ridged panel 110 with slot 116 in a substantially flat or not flexed state. Then, FIG. 8 shows flexible ridged panel 110 with slot 116 flexed inward in the direction of ridges 114. In this example, slot 116 allows clearance for ridges 114 to bend easily inward without stressing or compressing ridges 114. Then, FIG. 8 shows flexible ridged panel 110 with slot 116 flexed outward and away from ridges 114. In this example, slot 116 allows clearance for ridges 114 to flex without stressing or stretching ridges 114.

Slots 116 may be provided periodically along the length of each ridge 114 of flexible ridged panel 110. The width of slots 116 and the spacing of slots 116 may depend on the desired radius for coiling and spooling flexible ridged earth drain 102. In one example, the width of slots 116 may about 0.5 inches (about 1.27 cm) to about 0.75 inches (about 1.91 cm). Further, the spacing of slots 116 may range, for example, from about 12 inches (about 30.48 cm) to about 24 inches (about 60.96 cm). In similar fashion, FIG. 9 shows V-slots (or V-grooves) 116 for flexing the flexible ridged panel 110 shown in FIG. 4 through FIG. 7.

Further to the example, FIG. 10 is side views showing an example of a process of flexing flexible ridged earth drain 102 of the presently disclosed high flow capacity flexible earth drainage system 100. First, flexible ridged earth drain 102 including the back-to-back flexible ridged panels 110 within geotextile filter fabric sleeve 130 is shown in a substantially flat or not flexed state. Next, flexible ridged earth drain 102 is shown in a flexed state wherein, for example, the upward-facing flexible ridged panel 110 is flexed inwardly with respect to ridges 114 and the downward-facing flexible ridged panel 110 is flexed outwardly with respect to ridges 114. Using slots (or notches) 116 and/or V-slots (or V-grooves) 116, the developed bending that occurs in each flexible ridged panel 110 of flexible ridged earth drain 102 is relieved at prescribed intervals allowing for coiling and spooling.

Whereas FIG. 2 through FIG. 10 describe a single-sided flexible ridged panel 110, meaning ridges 114 extending from one side of panel substrate 112, a two-sided flexible ridged panel 110 is possible. For example, FIG. 11A and FIG. 11B is end views of an example of the flexible ridged earth drain 102 including a two-sided flexible ridged panel 110. In this example, flexible ridged earth drain 102 includes one flexible ridged panel 110 and wherein the one flexible ridged panel 110 includes panel substrate 112 with ridges 114 extending from both sides of panel substrate 112. For example, flexible ridged panel 110 includes panel substrate 112 with six (6) ridges 114 extending from both sides of panel substrate 112. Further, ridges 114 of two-sided flexible ridged panel 110 may include slots (or notches) 116 and/or V-slots (or V-grooves) 116.

For example, the six ridges 114 have an on-center spacing s1 of about 0.5 inches (about 1.27 cm). Accordingly, in this example, flexible ridged panel 110 has a width w of about 4 inches (about 10.16 cm). Further, panel substrate 112 of flexible ridged panel 110 has a thickness t1 and each ridge 114 has a thickness t2. The thicknesses t1 and t2 may range, for example, from about 0.15 inches (about 0.38 cm) to about 0.25 inches (about 0.64 cm). Further, each ridge 114 has a height h1 and there is a total height h2 (h2 being the sum of h1×2 and t1). The height h2 of ridges 114 may be selected so that they are long enough to result in high flow capacity yet still provide for a panel that is sufficiently flexible for efficient coiling and spooling, such as shown in FIG. 16. The height h2 may range, for example, from about 0.375 inches (about 0.95 cm) to about 0.75 inches (about 1.91 cm). Further, alternative materials and dimensions may be used provided that they allow effective flow volumes and drain stability.

Again, flexible ridged panels 110 may be formed, for example, of HDPE polymers, HDPP polymers, polyester polymers, composite synthetic materials, and the like. Again, flexible ridged panels 110 may be constructed by conventional extrusion of the melted polymer through a die.

Referring now to FIG. 12 and FIG. 13 is a perspective view and an end view, respectively, of an example of a flexible "zigzag" earth drain 102 for forming the presently disclosed high flow capacity flexible earth drainage system 100 shown in FIG. 1. Namely, flexible zigzag earth drain 102 is another example of the high flow capacity flexible earth drain 102 shown in FIG. 1. In this example, flexible zigzag earth drain 102 may include one flexible zigzag panel 120 arranged within a geotextile filter fabric sleeve 130.

As shown in FIG. 13, flexible zigzag panel 120 of flexible zigzag earth drain 102 may be a zigzag-shaped panel that has some number of peaks 122 and valleys 124. Further, FIG. 14 shows that flexible zigzag panel 120 has a width w. The width w may range, for example, from about 3.0 inches (about 7.62 cm) to about 4.0 inches (about 10.16 cm). Further, FIG. 14 shows that each flexible zigzag panel 120 has a length L, wherein the length L may be several feet or meters. Accordingly, each flexible zigzag earth drain 102 may be several feet or meters long. Further, flexible zigzag panel 120 may include slots (or notches) 116 and/or V-slots (or V-grooves) 116. Flexible zigzag panels 120 may be formed, for example, of HDPE polymers, HDPP polymers, polyester polymers, composite synthetic materials, and the like. Again, flexible zigzag panels 120 may be constructed by conventional extrusion of the melted polymer through a die.

In one example and referring now to FIG. 15, flexible zigzag panel 120 is a unitary zigzag panel that has five (5) peaks 122 and five (5) valleys 124. In this example, flexible zigzag panel 120 has a period p of about 1.0 inches (about 2.54 cm). Further, flexible zigzag panel 120 has a typical thickness t that may range, for example, from about 0.15 inches (about 0.38 cm) to about 0.25 inches (about 0.64 cm). Further, flexible zigzag panel 120 has an overall height h that may range, for example, from about 0.375 inches (about 0.95 cm) to about 0.75 inches (about 1.91 cm).

Referring now to FIG. 16 is a side view of an example of a driving rig 200 for installing flexible earth drain 102 of the presently disclosed high flow capacity flexible earth drainage system 100. Driving rig 200 may be a standard driving rig that includes a base machine 210, a mast 212, and a driving mandrel 214. Further, a spool 216 holding a coil of flexible earth drain 102 is provide at the base of mast 212. Namely, flexible earth drain 102 comes off of spool 216, then flexible earth drain 102 is fed through a guide channel 218 and over a shim 220 at the top of mast 212. Then, flexible earth drain 102 is fed top to bottom through driving mandrel 214. Then, a sacrificial steel bar or plate 105 is coupled to the end of flexible earth drain 102 exiting the bottom of driving mandrel 214. Flexible earth drain 102 may be any of the flexible earth drains described hereinabove with reference to FIG. 1 through 16. For example, flexible earth drain 102 may be any of the flexible "ridged" earth drains 102 described hereinabove with reference to FIG. 2 through 11B. Further, flexible earth drain 102 may be any of the flexible "zigzag" earth drains 102 described hereinabove with reference to FIG. 12 through 15.

Referring now to FIG. 17, FIG. 18, FIG. 19, and FIG. 20 are side views showing an example of a process 300 of installing flexible earth drain 102 of the presently disclosed high flow capacity flexible earth drainage system 100. Process 300 may be repeated at, for example, each flexible earth drain 102 site of high flow capacity flexible earth drainage system 100 shown in FIG. 1.

Figure 17:
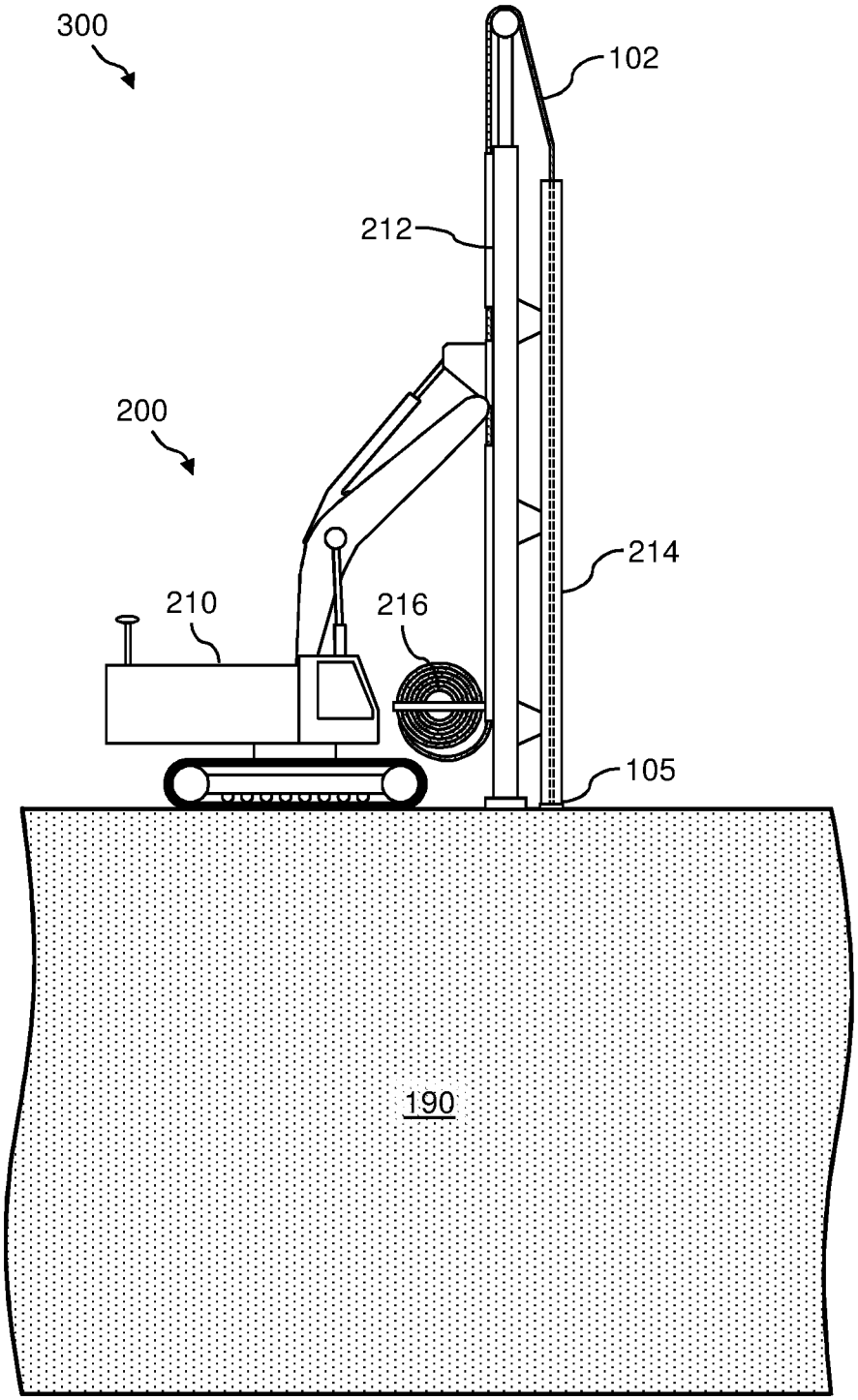

First, FIG. 17 shows driving mandrel 214 of driving rig 200 with a spool 216 of flexible earth drain 102 feeding into driving mandrel 214 in preparation for driving into the ground 190.

Figure 18:
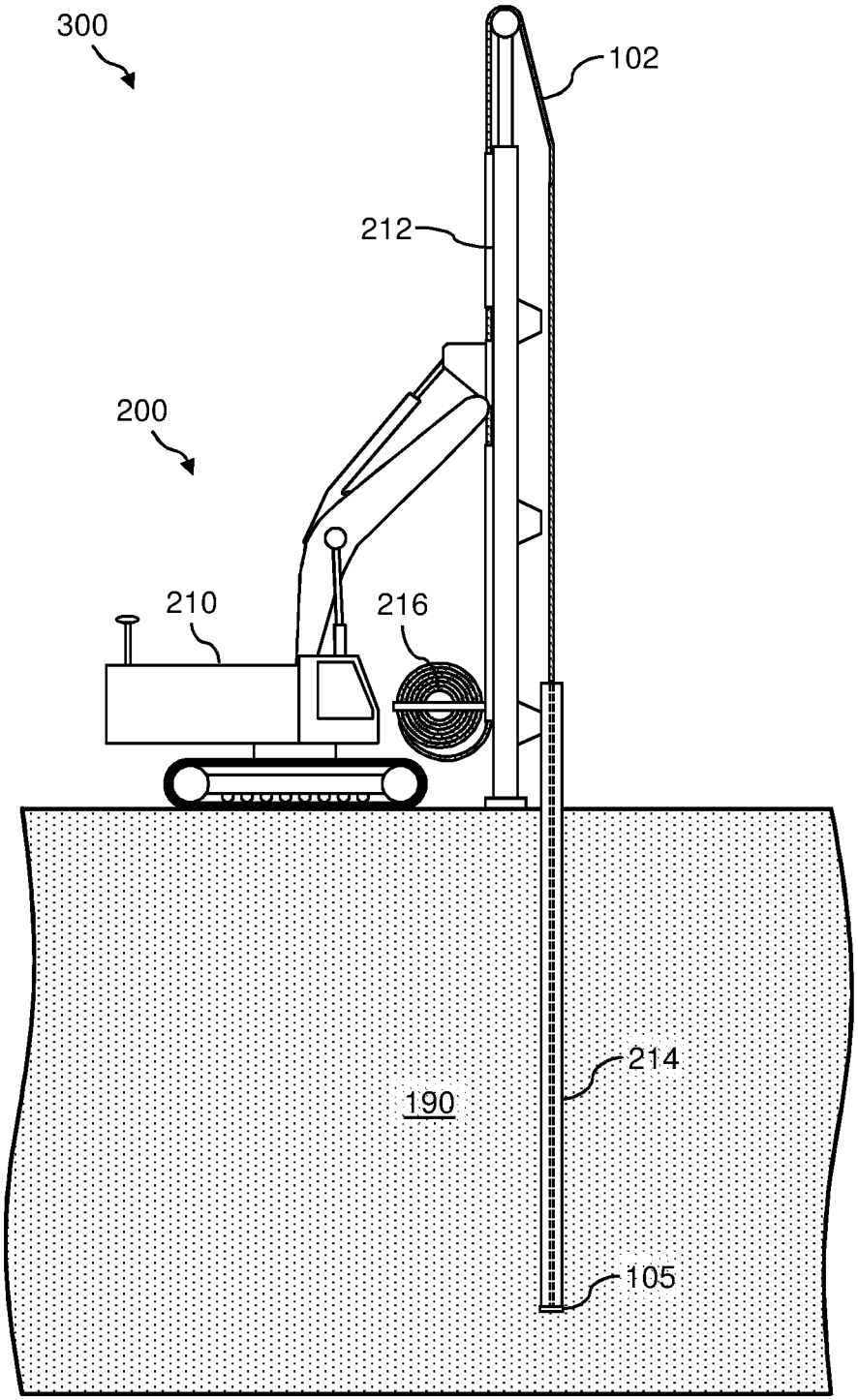

Next, FIG. 18 shows driving mandrel 214 advancing sacrificial steel bar or plate 105 and flexible earth drain 102 into the ground 190 via, for example, static pushing and optionally vibration.

Next, FIG. 19 shows driving mandrel 214 being withdrawn from the ground 190 and leaving sacrificial steel bar or plate 105 and flexible earth drain 102 in the ground 190.

Next, FIG. 20 shows the upper end of flexible earth drain 102 cut off at the surface of the ground 190 and held secure via a steel bar or plate 107, and with a length of flexible earth drain 102 in the ground 190 and with the lower end held secure via sacrificial steel bar or plate 105. Further, FIG. 20 shows a cross-sectional view of flexible earth drain 102 taken along line A-A in ground 190, and indicating a flow path 140 may occur in the spaces/voids of flexible earth drain 102. Specifically, the spaces/voids of flexible earth drain 102 provide vertical drainage channels to convey water upward. Accordingly, a vertical flow path 140 may occur through flexible earth drain 102 from sacrificial steel bar or plate 105 at the lower end of flexible earth drain 102 to steel bar or plate 107 at the upper end of flexible earth drain 102, which is at the surface of ground 190.

Referring now to FIG. 21 is a flow diagram of an example of a method 400 of installing high flow capacity flexible earth drains 102 to form the presently disclosed high flow capacity flexible earth drainage system 100 for relieving and conveying pore water. Method 400 may include, but is not limited to, the following steps.

At a step 410, spools of high flow capacity flexible earth drains 102 are provided. For example, coils of high flow capacity flexible earth drains 102 may be provided on spools 216 to be mounted on driving rig 200, as shown in FIG. 16. In one example, the high flow capacity flexible earth drains 102 may include the flexible "ridged" panels 110 shown and described with reference to FIG. 2 through FIG. 11B. In another example, the high flow capacity flexible earth drains 102 may include the flexible "zigzag" panels 110 shown and described with reference to FIG. 12 through FIG. 15.

At a step 415, high flow capacity flexible earth drain 102 is fed to and through driving mandrel 214 of driving rig 200. For example, the end of high flow capacity flexible earth drain 102 is fed to and through driving mandrel 214 of driving rig 200 and attached to sacrificial steel bar or plate 105 in preparation for driving into the ground, as shown, for example, in FIG. 17.

At a step 420, driving mandrel 214 holding high flow capacity flexible earth drain 102 with the sacrificial steel bar or plate 105 is advanced into the ground 190, as shown, for example, in FIG. 18. For example, driving mandrel 214 is used to advance sacrificial steel bar or plate 105 and flexible earth drain 102 into the ground 190 via, for example, static pushing and optionally vibration. In this step, flexible earth drain 102 is kept from being pushed up driving mandrel 214 because it is attached to the sacrificial steel bar or plate 105 whose ends bear against the bottom of driving mandrel 214 during pushing.

At a step 425, driving mandrel 214 is withdrawn from the ground 190 and leaving sacrificial steel bar or plate 105 and flexible earth drain 102 in the ground 190, as shown, for example, in FIG. 19. Namely, once flexible earth drain 102 reaches the design depth, driving mandrel 214 is withdrawn upwards by driving rig 200. Flexible earth drain 102 remains in the ground 190 because the sacrificial steel bar or plate 105 penetrates sideways into the soil at the bottom of the drain and resists upward movement while driving mandrel 214 is extracted.

At a step 430, the upper end of flexible earth drain 102 is cut off at the surface of the ground 190 and held secure via a steel bar or plate 107, as shown, for example, in FIG. 20. Accordingly, a length of flexible earth drain 102 is installed in the ground 190 and with the lower end held secure via sacrificial steel bar or plate 105.

At a step 435, driving rig 200 is moved to the next drain site and then method steps 415, 420, 425, and 430 are repeated until all drain sites are installed to form, for example, high flow capacity flexible earth drainage system 100 shown in FIG. 1.

EXAMPLE

The present subject matter was deployed at a project site under the control of a design-build contractor in Iowa. The installation rig is, for example, driving rig 200 shown in FIG. 16. The installations were facilitated using driving mandrel 214 pushed downward into the soil using a conventional driving motor. A flexible earth drain 102 with the general configurations shown in FIG. 2 and FIG. 3 was coiled and placed on spool 216 that was hung at the bottom of the driving mast. The end of flexible earth drain 102 was fed over shim 220 at the top of mast 212 and fed downwards into driving mandrel 214. When exited, the bottom of flexible earth drain 102 was connected to a rebar (i.e., sacrificial steel bar or plate 105) to prevent flexible earth drain 102 from entering back up into driving mandrel 214 during driving. The driving mandrel 214 was pushed downward into the soil and then extracted. The flexible earth drain 102 was cut above the ground surface and the bottom of the remaining flexible earth drain 102 in driving mandrel 214 was connected to a rebar. The second flexible earth drain 102 was then installed. The rate of installations approximates that for conventional PVDs.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. An apparatus for providing high flow capacity flexible soil drains comprising:

a drain having a central core of a synthetic material configured to provide for low bending stiffness, wherein the central core comprises at least one solid ridged panel comprising one or more ridges; and a surrounding filter fabric, wherein the at least one solid ridged panel comprises a pair of flexible ridged panels arranged back-to-back within the surrounding filter fabric.

2. The apparatus of claim 1, wherein the central core has two or more panels adapted to slip longitudinally along the length of the drain.

3. The apparatus of claim 1, wherein the central core has one or more panels that are scored with slits running transverse to the axis of the drain.

4. A high flow capacity flexible earth drainage system for relieving and conveying pore water, comprising:

an arrangement of flexible earth drains, wherein each flexible earth drain includes one or more flexible panels within a filter sleeve, wherein the one or more flexible panels comprise a pair of flexible ridged panels arranged back-to-back within the filter sleeve, wherein the arrangement of flexible earth drains is a line or an array with a spacing s between the flexible earth drains.

5. The high flow capacity earth drainage system of claim 4, wherein the spacing s ranges from about 4.0 feet (about 1.22 meters) to about 10.0 feet (about 3.05 meters).

6. The high flow capacity earth drainage system of claim 4, wherein the one or more flexible panels is arranged longitudinal within the filter sleeve, and wherein the filter sleeve is made of a geotextile fabric that is tubular shaped to fit around the one or more flexible panels.

7. The high flow capacity earth drainage system of claim 6, wherein the geotextile fabric is spunbond nonwoven geotextile filter fabric material.

8. The high flow capacity earth drainage system of claim 4, wherein the overall height of the pair of flexible ridged panels is about 0.75 inches (about 1.9 cm).

9. The high flow capacity earth drainage system of claim 4, wherein the one or more flexible panels is a flexible ridged panel constructed by extrusion of a polymer through a die.

10. The high flow capacity earth drainage system of claim 9, wherein the polymer has a low friction angle, and wherein the polymer is HDPE, HDPP, polyester polymers, or composite synthetic materials.

11. The high flow capacity earth drainage system of claim 9, wherein each flexible ridged panel of the one or more flexible ridged panels is a panel substrate with multiple ridges.

12. The high flow capacity earth drainage system of claim 11, wherein any two adjacent ridges of the multiple ridges coupled by a segment of the panel substrate form a rectangular element.

13. The high flow capacity earth drainage system of claim 11, wherein each ridge of the multiple ridges has a slot formed substantially within the ridge.

14. The high flow capacity earth drainage system of claim 13, wherein the slots are substantially in a line across the multiple ridges of the flexible ridged panel.

15. The high flow capacity earth drainage system of claim 13, wherein the slot is more than one slot along the length of each ridge of the flexible ridged panel.

16. The high flow capacity earth drainage system of claim 13, wherein the slot is a V-groove.

17. The high flow capacity earth drainage system of claim 11, wherein the multiple ridges are eleven ridges protruding orthogonally from one side of the panel substrate.

* * * * *